US006446842B2

(12) United States Patent
Stern et al.

(10) Patent No.: US 6,446,842 B2
(45) **Date of Patent: *Sep. 10, 2002**

(54) AEROSOL SPRAY TEXTURING DEVICES

(75) Inventors: Donald J. Stern, Portland, OR (US); James A. Tryon, Seattle, WA (US)

(73) Assignee: Homax Products, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/904,878

(22) Filed: Jul. 11, 2001

Related U.S. Application Data

(63) Continuation of application No. 09/659,886, filed on Sep. 12, 2000, now Pat. No. 6,276,570, which is a continuation of application No. 09/407,807, filed on Sep. 28, 1999, now Pat. No. 6,116,473, which is a continuation of application No. 08/626,834, filed on Apr. 2, 1996, now Pat. No. 5,715,975, which is a continuation-in-part of application No. 08/321,559, filed on Oct. 12, 1994, now Pat. No. 5,524,798, which is a continuation-in-part of application No. 08/238,471, filed on May 5, 1994, now Pat. No. 5,409,148, which is a continuation of application No. 08/216,155, filed on Mar. 22, 1994, now Pat. No. 5,450,983, which is a continuation of application No. 07/840,795, filed on Feb. 24, 1992, now Pat. No. 5,310,095.

(51) Int. Cl.[7] ..... B65D 83/14
(52) U.S. Cl. ..... 222/402.1; 239/391; 239/397
(58) Field of Search ..... 222/402.1, 402.17, 222/394; 239/337–390, 391, 393–395, 348

(56) References Cited

U.S. PATENT DOCUMENTS

| | | | |
|---|---|---|---|
| D25,916 S | 8/1896 | Woods | |
| 568,976 A | 10/1896 | Regan | |
| 579,418 A | 3/1897 | Bookwalter | |
| 582,397 A | 5/1897 | Shone | |
| 658,586 A | 9/1900 | Reiling | |
| 941,671 A | 11/1909 | Campbell | |
| 1,093,907 A | 4/1914 | Birnbaum | |

(List continued on next page.)

FOREIGN PATENT DOCUMENTS

| | | |
|---|---|---|
| DE | 1926796 | 3/1970 |
| FR | 1586067 | 2/1970 |
| GB | 867713 | 5/1961 |
| GB | 1144385 | 3/1969 |

*Primary Examiner*—Philippe Derakshani
(74) *Attorney, Agent, or Firm*—Michael R. Schacht; Schacht Law Office Inc.

(57) ABSTRACT

An apparatus for applying spray texture to a wall or the like. The apparatus comprises an aerosol can containing pressurized spray texture material. The spray texture material is released from the can by a valve and passes through a nozzle passageway, out of a discharge opening, and on to a surface to be textured. The apparatus further comprises an outlet member that can be placed over the discharge opening to vary the effective cross-sectional area thereof. This outlet member can be in the form of a straw or tube that is inserted into the nozzle passageway or a disc or other member having a plurality of outlet orifices formed therein. The outlet member having a plurality of outlet orifices can be attached directly to an actuator member in which the dispensing passageway is formed. By rotating, sliding, or otherwise moving the outlet member relative to the actuator member, any one of the outlet orifices in the outlet member can be arranged at the end of the nozzle passageway to vary the effective cross-sectional area of the discharge opening.

20 Claims, 14 Drawing Sheets

U.S. PATENT DOCUMENTS

| | | | | |
|---|---|---|---|---|
| 1,154,974 | A | | 9/1915 | Custer |
| 1,486,156 | A | | 3/1924 | Needham |
| 2,127,188 | A | | 8/1938 | Schellin et al. |
| 2,149,930 | A | | 3/1939 | Plastaras |
| D134,562 | S | | 12/1942 | Murphy |
| 2,307,014 | A | | 1/1943 | Becker et al. |
| 2,320,964 | A | | 6/1943 | Yates |
| 2,388,093 | A | | 10/1945 | Smith |
| 2,530,808 | A | | 11/1950 | Cerasi |
| 2,785,926 | A | | 3/1957 | Lataste |
| 2,790,680 | A | | 4/1957 | Rosholt |
| 2,997,243 | A | | 8/1961 | Kolb |
| 3,083,872 | A | | 4/1963 | Meshberg |
| 3,184,326 | A | | 5/1965 | Bartlett |
| 3,246,850 | A | | 4/1966 | Bourke |
| 3,258,208 | A | | 6/1966 | Greenbaum, II |
| 3,342,382 | A | | 9/1967 | Huling ..... 222/402.17 |
| 3,377,028 | A | | 4/1968 | Bruggeman |
| 3,514,042 | A | | 5/1970 | Freed |
| 3,596,835 | A | | 8/1971 | Smith et al. |
| 3,703,994 | A | | 11/1972 | Nigro |
| 3,704,831 | A | | 12/1972 | Clark |
| 3,777,981 | A | | 12/1973 | Probst et al. |
| 3,795,366 | A | | 3/1974 | McGhie et al. ..... 222/402.17 |
| 3,811,369 | A | | 5/1974 | Ruegg |
| 3,891,128 | A | | 6/1975 | Smrt |
| 3,936,002 | A | | 2/1976 | Geberth, Jr |
| 3,982,698 | A | | 9/1976 | Anderson |
| 4,187,985 | A | | 2/1980 | Goth |
| 4,411,387 | A | | 10/1983 | Stern et al. |
| 4,815,414 | A | | 3/1989 | Duffy et al. |
| D307,640 | S | | 5/1990 | Henry |
| 4,955,545 | A | | 9/1990 | Stern et al. |
| 4,961,537 | A | | 10/1990 | Stern |
| 5,037,011 | A | | 8/1991 | Woods ..... 222/394 |
| 5,069,390 | A | | 12/1991 | Stern et al. |
| 5,100,055 | A | | 3/1992 | Rokitenetz et al. |
| 5,188,295 | A | | 2/1993 | Stern et al. |
| 5,307,964 | A | | 5/1994 | Toth |
| 5,310,095 | A | * | 5/1994 | Stern et al. ..... 222/402.1 |
| 5,409,148 | A | | 4/1995 | Stern et al. ..... 239/391 |
| D358,989 | S | | 6/1995 | Woods |
| 5,421,519 | A | | 6/1995 | Woods |
| 5,450,983 | A | | 9/1995 | Stern et al. ..... 222/394 |
| 5,524,798 | A | | 6/1996 | Stern et al. ..... 222/402.1 |
| 5,715,975 | A | * | 2/1998 | Stern et al. ..... 222/402.1 |
| 6,276,570 | B1 | * | 8/2001 | Stern et al. ..... 222/402.1 |

* cited by examiner 160
174
162
176
164
172
166
136
126
124
158
168
170
D,E,F
$d_a$
$d_1$
X
$d_c$
A,G
128a
178
130
156
138
150
154
134
122
140
132
144
146
142
148
152

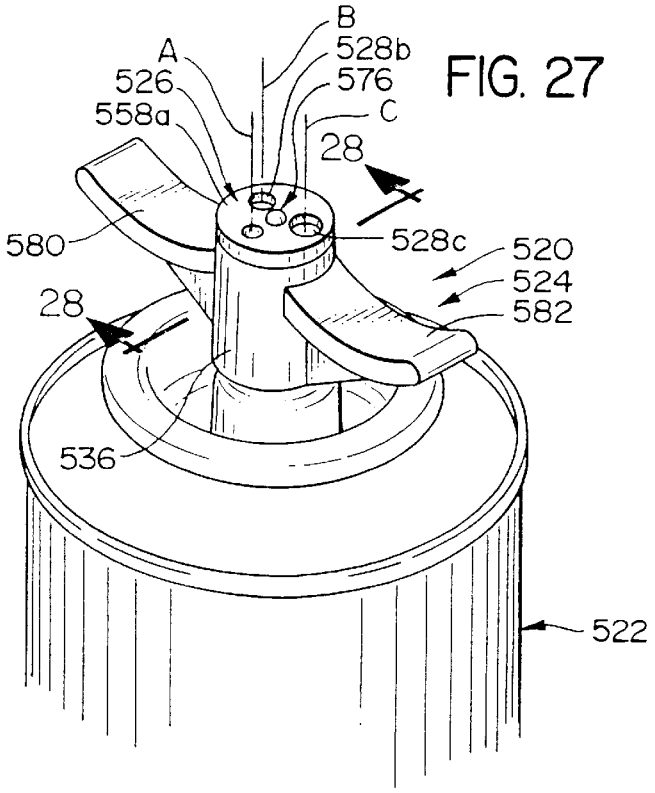
FIG. 27
FIG. 28
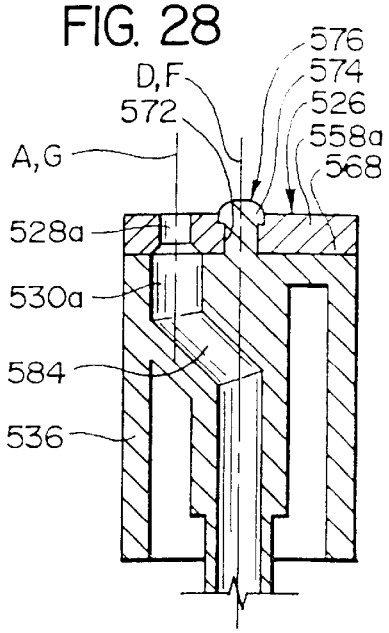
FIG. 29
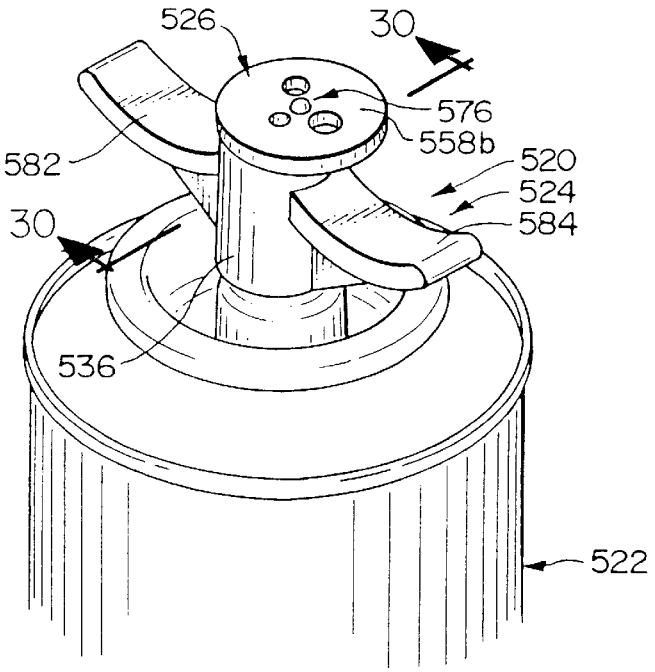
FIG. 30
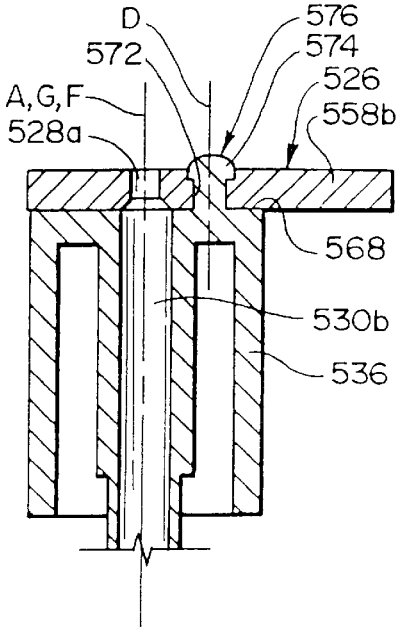

FIG. 31A
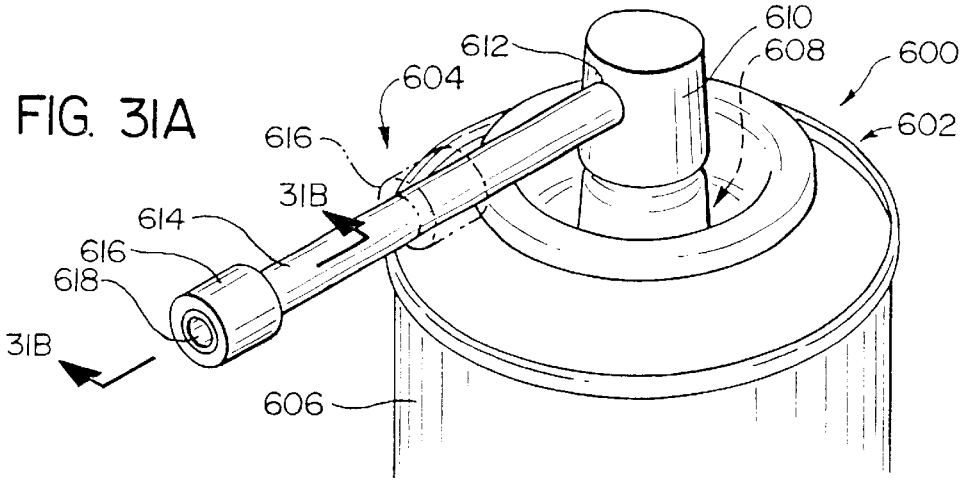
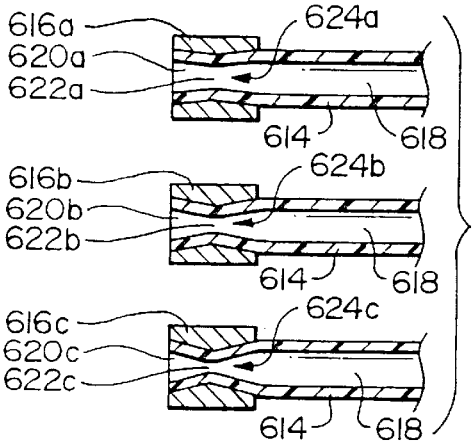
FIG. 31B
FIG. 33A
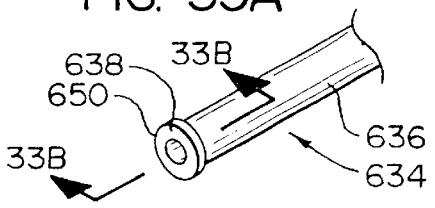
FIG. 32
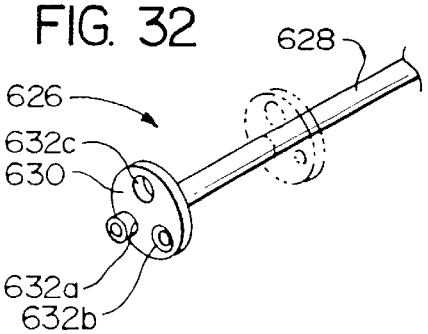
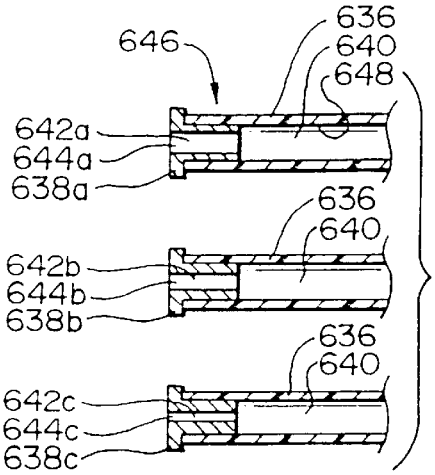
FIG. 33B

AEROSOL SPRAY TEXTURING DEVICES

RELATED APPLICATIONS

This is a continuation of application Ser. No. 09/659,886, Sep. 12, 2000 now U.S. Pat. No. 6,276,570, which is a continuation of application Ser. No. 09/407,807, Sep. 28, 1999, U.S. Pat. No. 6,116,473, which is a continuation of application Ser. No. 08/626,834, Apr. 2, 1996, U.S. Pat. No. 5,715,975, which is a continuation-in-part of application Ser. No. 08/321,559, Oct. 12, 1994, U.S. Pat. No. 5,524,798, which is a continuation-in-part of application Ser. No. 08/238,471, May 5, 1994, U.S. Pat. No. 5,409,148, which is a continuation of application Ser. No. 07/840,795, Feb. 24, 1992, U.S. Pat. No. 5,310,095 and application Ser. No. 08/216,155, Mar. 22, 1994, U.S. Pat. No. 5,450,983, the subject matter of which is incorporated herein by reference.

TECHNICAL FIELD

The present invention relates to the art of spray texturing, and more particularly to an apparatus and method by which spray texturing can be accomplished to provide spray patterns of varying texture (i.e. with either finer or more coarse particle size).

BACKGROUND OF THE INVENTION

When drywall panels are installed in a building, and the seams taped, prior to painting the wall surface, there is often applied a spray texture, which is followed by painting. The spray texture will provide a desirable background pattern, and also obscure some of the seams that might appear in the drywall surface.

There are in the prior art various spray texturing tools or devices which utilize pressurized air to spray the texture material onto the wall surface. Some of these use compressed air as the gaseous medium to spray the textured material, with the pressurized air being derived from a remote source that feeds the air through a hose to the tool. There are also tools which are totally handheld, with the pressurized air being produced by manually reciprocating the piston of an air pump that is built into the tool.

When an existing drywall surface is being repaired, quite often a small section of drywall will be removed and another piece of drywall put in its place. The seams of this piece of drywall must then be taped, and (if the surrounding surface is textured) then have a texture surface treatment that would make it match with the surrounding drywall surface. It is, of course, desirable to have the spray pattern on the patch match that of the surrounding surface.

Also, when a rather small "patch" of drywall is to be spray textured, there is the matter of convenience. One approach has been simply to provide the spray texture material in an aerosol can, and the textured material is dispensed directly from the can to be sprayed onto the drywall surface. However, one of the considerations is how this can be accomplished in a manner to provide proper matching of the texture with that which is on the surrounding drywall.

U.S. Pat. No. 5,037,011 (Woods) discloses such an aerosol texture spraying device where the spray texture material is dispensed directly from the nozzle of the aerosol can. In a commercial embodiment of a device such as this, when there is higher pressure in the container, there is a relatively fine spray pattern. For a more coarse pattern (i.e. with larger particle sizes), the can is inverted and the nozzle depressed to dispense a certain amount of the propellant gas for a few seconds. Then the can is turned upright and the spray texture material dispensed at a lower pressure to provide the spray pattern with larger particle sizes.

U.S. Pat. No. 5,310,095 issued to the present Applicant discloses an apparatus for discharging a spray texture material through a nozzle means having a nozzle discharge opening to dispense this material. There is further provided a first delivery tube means having a first discharge passageway of a first predetermined cross-sectional area. The material discharge apparatus is operated to cause the textured material to be discharged through the tube means. Then a second discharge tube means is positioned to receive material from the discharge nozzle means, and this second tube means has a second discharge passageway with a second predetermined cross-sectional area different from the first cross-sectional area. Thus, the '095 patent disclosed obtaining a finer spray pattern by utilizing a tube means with a passageway having a lesser cross-sectional area and a coarse pattern by discharging said material through the tube means having a greater cross-sectional area.

A primary problem with the method disclosed in the '095 patent is that a plurality of parts must be manufactured, shipped, sold, assembled and stored by the end user in order to maintain the capability of the product to create different texture patterns.

With the '095 patent, three straws must be sold in connection with the aerosol can. While this method is quite inexpensive from a manufacturing point of view, the shipping and sale of the product are somewhat complicated a by the need to attach the three straws to the aerosol can. Further, the end user must install the straws into the actuating member of the aerosol can; this is difficult to accomplish without depressing the actuating member and discharging some of the texture material. Also, after the product disclosed in the '095 patent is used, the user must store the straws such that they are easily available when needed.

Accordingly, the need exists for a spray texturing device that is easy to use, inexpensive to manufacture, does not require user assembly, and does not require the shipment and storage of a plurality of parts.

OBJECTS OF THE INVENTION

From the foregoing, it should be apparent that one object of the present invention is to provide an improved apparatus for applying spray texture material to a patch in a wall or the like.

Another object of the present invention is to provide a spray texturing apparatus having a favorable balance of the following characteristics:

a. inexpensively manufactured;

b. does not require manufacture, shipment, sale, and storage of an excessive number of separate components; and c. obviates the need for the end user to assemble several parts together.

SUMMARY OF THE INVENTION

The present invention is a system or method that allows an operator to apply texture to a surface in a desired texture pattern that substantially matches a pre-existing texture pattern. The system/method of the present invention employs an aerosol container with an internal valve assembly and structure that defines an outlet opening through which texture material passes as the texture material is dispensed. A primary feature of the present invention is that the cross-sectional area of the outlet opening can be changed to alter the texture pattern. The structure that allows the cross-sectional area to be changed can either allow a discrete number of cross-sectional areas or can be a continuous structure that allows an infinite number of cross-sectional areas.

BRIEF DESCRIPTION OF THE DRAWING

FIG. 27 is a perspective view of another exemplary spray texturing apparatus constructed in accordance with, and embodying, the principles of the present invention;

FIG. 28 is a partial cut-away view taken along lines 28—28 in FIG. 27;

FIG. 29 is a perspective view of another exemplary spray texturing apparatus constructed in accordance with, and embodying, the principles of the present invention;

FIG. 30 is a partial cut-away view taken along lines 30—30 in FIG. 29;

FIG. 31A depicts an isometric view of a spray texturing apparatus constructed in accordance with, and embodying, the principles of the present invention;

FIG. 31B is a section view taken along lines 31*b*—31*b* in FIG. 31A;

FIG. 32 is a perspective view of yet another exemplary embodiment of an aerosol texture material dispensing apparatus;

FIG. 33A is a perspective view showing a portion of a discharge assembly constructed in accordance with the present invention;

FIG. 33B are section views taken along lines 33*b* in FIG. 33A;

FIG. 44 is a section view showing yet another exemplary discharge assembly adapted to dispense texture material on a ceiling surface or the like;

FIG. 45 is a section view showing a discharge assembly adapted to apply texture material to upper regions of a wall or a ceiling or the like;

DETAILED DESCRIPTION

Figure 1:
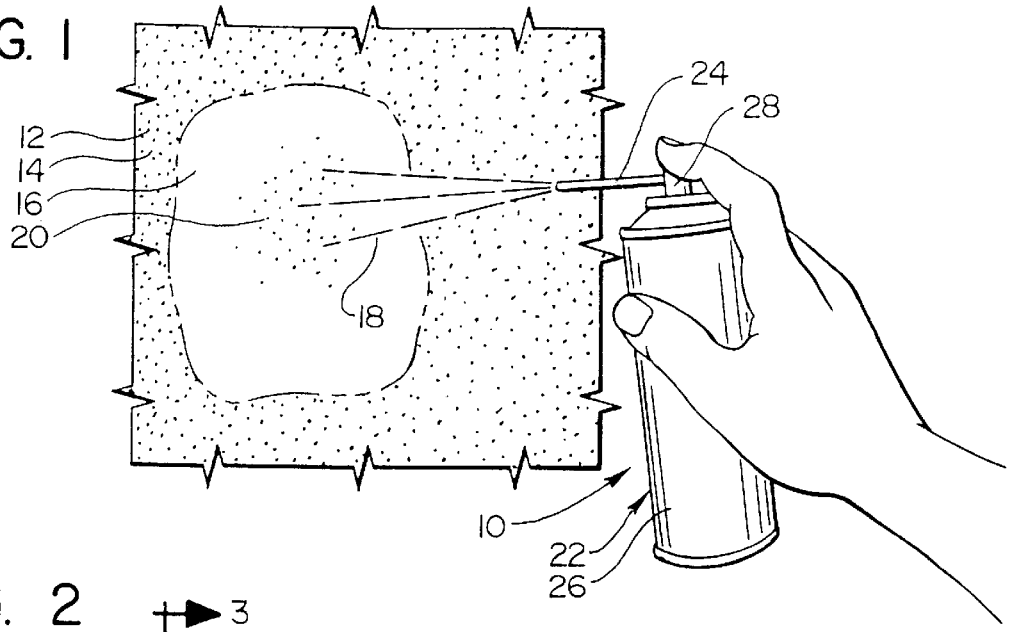
FIG. 1 is an isometric view illustrating a preferred embodiment of the present invention applying a spray texture material to a patch on a drywall surface.

In FIG. 1, there is shown the apparatus 10 of the present invention being used in spraying the texture material onto a section of wallboard 12 having a previously sprayed surface portion 14 surrounding an unsprayed portion 16 which could be, for example, a more recently applied piece of wallboard that serves as a "patch". The spray itself is indicated at 18, and the spray material deposited on the wall portion 16 as a sprayed texture is indicated at 20.

Figure 2:
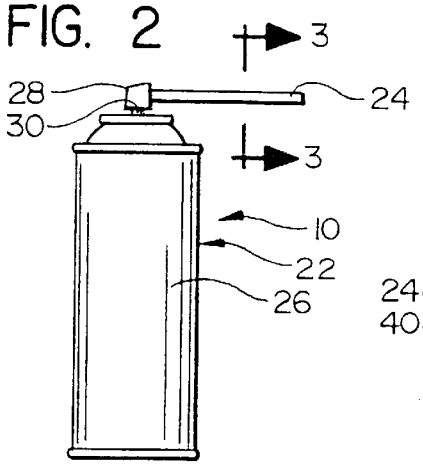
FIG. 2 is a side elevational view of the apparatus of the present invention.

With reference to FIG. 2, the present invention is shown, in one exemplary form, incorporated with an aerosol spray containing device 22, the basic design of which is or may be conventional in the prior art. Used in combination with this container 22 is a dispensing tube 24. It has been found by utilizing this dispensing tube 24 in particular arrangements to discharge the spray texture material, more precise control of the spray texture pattern can be achieved. Further, there are other advantages, in that not only is a more controllable spray pattern achieved, but this consistency of the spray pattern can be accomplished for a relatively long period of use. In other words, even after a substantial amount of the spray texture material has been already discharged from the aerosol dispensing container 22, the spray pattern remains rather consistent. The manner in which this is achieved will be described more fully later herein.

It is recognized that in the prior art tubular members have been used in combination with an aerosol spray can to deliver a material, such as a lubricant. To the best knowledge of the applicants, however, this use has been primarily to enable the aerosol container to deliver the fluid, such as a lubricating oil, to a somewhat inaccessible location, and not to achieve the ends of the present invention.

In the following detailed description of the invention, a number of embodiments of the present invention are described. These embodiments illustrate the present invention incorporates two features that may be used singly or together. These two features are the use of an elongate passageway through which texture material may pass before it exits an aerosol device and the use of a plurality of outlet orifice configurations, where by outlet orifice has a different cross-sectional area for each of the configurations. The technical advantages obtained by these features will be described in detail below.

The embodiments of the present invention described in this application illustrate that a given embodiment can contain one or both of these features and that these features can be implemented in a variety of different configurations.

Accordingly, the present application illustrates that, for a given set of design criteria, the designer has significant flexibility to construct an aerosol device for dispensing texture material that accomplishes the design goals inherent in the set of criteria.

To return to our description of the aerosol dispensing device 22, as indicated above, the basic design is or may be conventional. As shown herein, the device 22 comprises a cylindrical container 26 and a dispensing nozzle member 28 positioned at the top of the container 26. As is common in the prior art, this dispensing member 28 in its upright position blocks flow of material from the container 26. This dispensing member 28 is attached to a downwardly extending stem 30, and when the member 28 is depressed, a valve opens within the container 22 so that the material in the container 22 flows upwardly through the stem 30 and laterally out a nozzle formed in the dispensing nozzle member 28. Since the manner in which this is achieved is well known in the prior art, this will not be described in detail herein.

Figure 16:
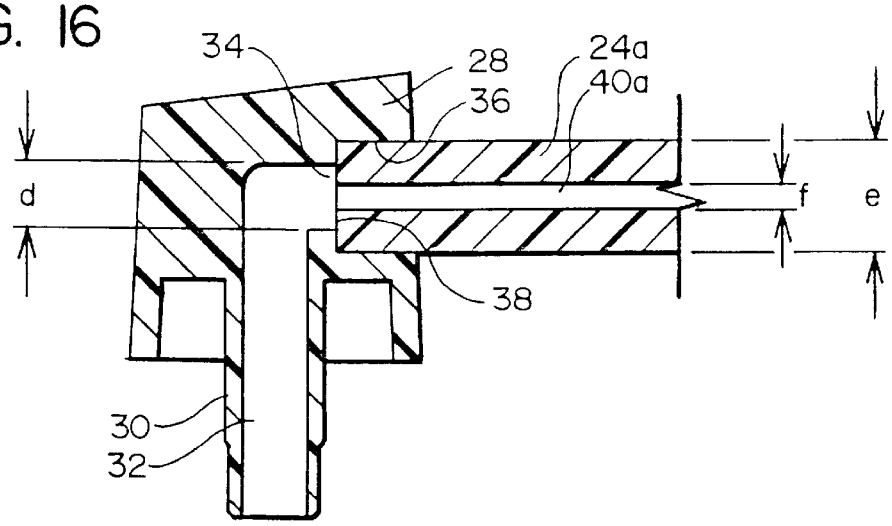
FIG. 16 is a cross sectional view taken through the dispensing head of the aerosol container, with this plane being coincident with the lengthwise axis of the dispensing tube and the vertical axis of the dispensing head, showing only the discharge orifice portion of the dispensing head, and further with the smaller inside diameter tube shown in FIG. 3.
Figure 17:
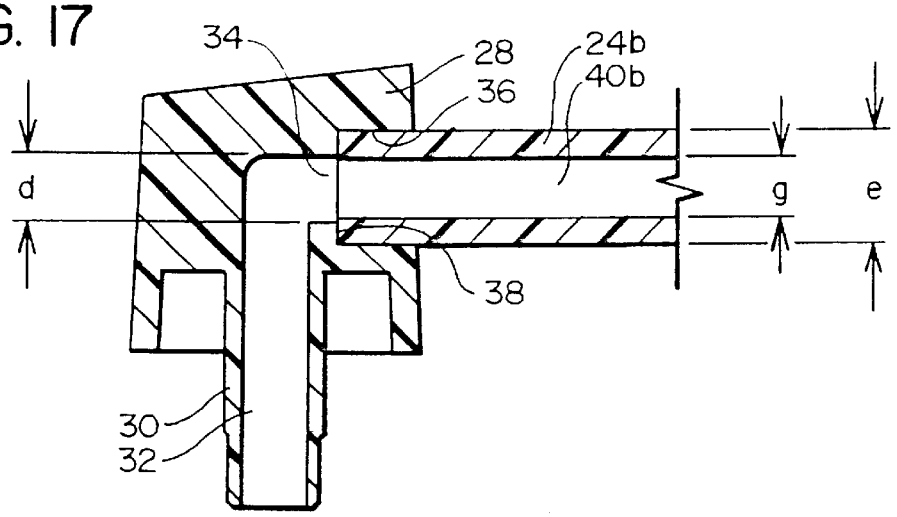
FIG. 17 is a view similar to FIG. 16, but showing the dispensing head having the medium inside diameter tube of FIG. 5 positioned therein.
Figure 18:
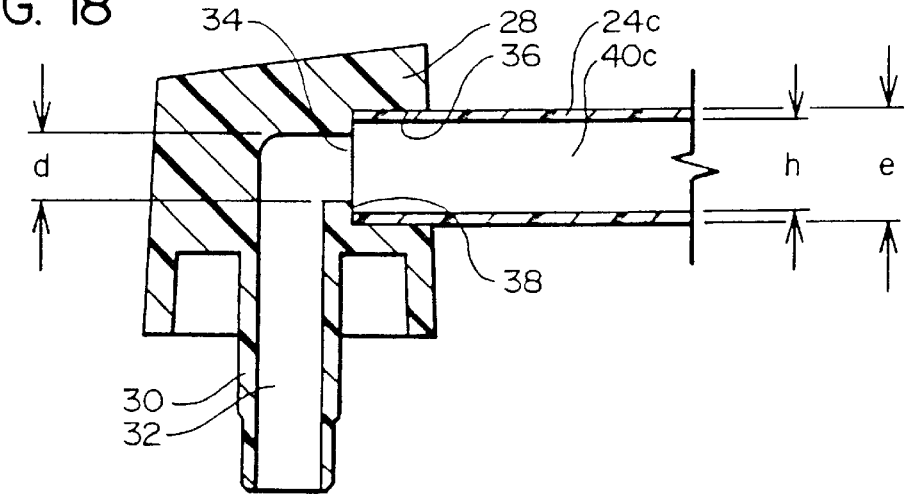
FIG. 18 is a view similar to FIGS. 16 and 17, but showing the dispensing tube of FIG. 7 having the largest inside diameter, as shown in FIG. 7.

Reference is now made to FIGS. 16 through 18, and it can be seen that the stem 30 provides a passageway 32 through which the spray texture material flows upwardly, and then is directed laterally to be discharged through a lateral nozzle opening 34. The passageway 32 and nozzle 34 can have their dimensions and configuration optimized for proper performance, and the manner in which this is done is also known in the prior art.

In the present invention, the nozzle member 28 is provided with a counterbore 36 having a moderately enlarged diameter, relative to the diameter of the nozzle opening 34. Both the nozzle opening 34 and the counter-bore 36 have a cylindrical configuration. The dispensing tube 24 has an outside diameter so that its end portion is able to fit snugly within the counterbore 36, with the end surface of the tube 34 bearing against the forwardly facing annular shoulder 38 defined by the counterbore 36 with the nozzle opening 34.

Figure 3:
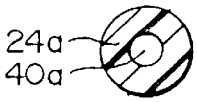
FIG. 3 is a sectional view taken along 3—3 of FIG. 2, this being done to illustrate the inside diameter of the discharge tube which is made relatively small to provide a spray texture pattern of a more fine particle size.
Figure 7:
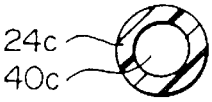
FIGS. 7 and 8 are similar to FIGS. 3 and 4, respectively, with FIG. 7 showing the cross section of a discharge tube of yet larger inside diameter for the flow passageway, and FIG. 8 showing the spray pattern with a yet larger particle size.

In one preferred embodiment of the present invention, a plurality of dispensing tubes 24 are provided, and in the present embodiment, there are three such tubes, 24*a*, 24*b* and 24*c*. It can be seen from examining FIGS. 3, 5 and 7 (and also FIGS. 16, 17 and 18) that the outside diameter of all three tubes 24*a*, 24*b*, and 24*c* have the same outside diameter, but different inside diameters for the discharge passageway 40.

Figure 4:
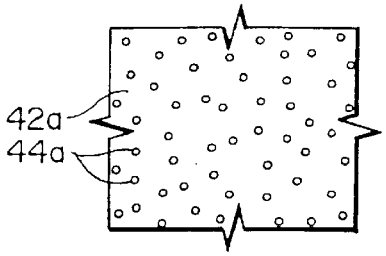
FIG. 4 illustrates somewhat schematically a spray texture pattern in a wall surface which has relative fine particle size.

It has been found that by selecting different diameters for the discharge passageway 40, the spray texture pattern can be controlled more accurately. With the smaller diameter 40*a* of the discharge tube 24*a*, shown in FIG. 3, a relatively fine spray texture pattern can be achieved, as shown in FIG. 4, where the particles of spray texture material are of a small particle size, as shown in the wall section 42*a*.

Figure 5:
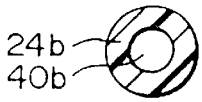
FIGS. 5 and 6 are views similar to FIGS. 3 and 4, with FIG. 5 showing a discharge passageway of a larger inside diameter, and FIG. 6 showing the spray pattern with a larger particle size.
Figure 8:
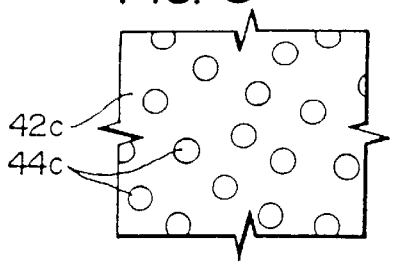

In FIG. 5, the interior discharge passageway 40*b* is of a more intermediate size, and this results in a discharge pattern which has a somewhat larger particle size, as shown in the wall section 42*b*. Then, with the yet larger diameter discharge opening 40*c*, as can be seen in FIG. 8, the wall section 42*c* having a spray texture pattern with a yet larger particle size. The particles of the board section 42*a*, 42*b*, and 42*c* are designated as, respectively, 44*a*, 44*b* and 44*c*.

With regard to the spray texture material itself, if has been found that quite desirable results can be achieved where the basic composition of the spray texture material comprises a resin or resins, particulate filler material and a propellant. Also, there is a solvent, and desirably dryers to accelerate the drying reaction of the resin with oxygen.

More specifically, the resin or resins desirably comprise alkyd resins, and more specifically those which are generally called bodying alkyds or puffing alkyds.

Such alkyds are sometimes used for what are called "architectural coatings". The resins are made somewhat more gelatinous than would be used in other applications, this depending upon the spray characteristics that are desired. If the alkyd resins are made more gelatinous or viscous, a coarser spray pattern would be expected for a particular set of conditions.

The particulate filler material desirably has various particle sizes, and this can be a filler material or materials which are well known in the prior art, such as calcium carbonate, silica, talc, wollastonite, various types of pigments, etc.

The propellant is desirably a liquefied hydrocarbon gas, with this liquefied gas being dispersed throughout the texture material composition, such as being dissolved therein or otherwise dispersed therein. The propellant is characterized that under the higher pressure within the container the propellant remains dispersed or dissolved as a liquid throughout the spray texture material, and upon release of pressure, the propellant begins going back to its gaseous form to act as a propellant and push the material up the stem passageway 32 and out the nozzle opening 34.

The solvent is desirably aromatic and/or aliphatic hydrocarbons, ketones, etc.

The dryer or dryers would normally be metallic dryer, such as various metal salts. These are already well known in the art, so these will not be described in detail herein.

It has been found that this type of texture material can be sprayed by using the present invention to provide a reasonably consistent spray texture for a given configuration of the tube 24. Also, it has been found that this consistency of spray pattern can be accomplished throughout the discharge of the great majority of the spray texture material within the container 26.

With regard to the particular dimensions utilized in this preferred embodiment of the present invention, reference is made to FIGS. 16 through 18. The diameter "d" of the nozzle orifice 34 is in this particular embodiment 0.102 inch, and the diameter of the counter-bore (indicated at "e") is 0.172 inch; the diameter "f" of the passageway 40*a* (i.e. the smallest diameter passageway) is 0.050 inch; the diameter "9" of the intermediate sized passageway 40*b* (see FIG. 17) is 0.095 inch; and the diameter "h" of the largest tube passageway 40*c* is 0.145 inch.

Thus, it can be seen in the arrangements of FIGS. 16 through 18 that in FIG. 16, there is a substantial reduction in the cross-sectional area of the passageway 40*a*, with this having about one half the diameter of the nozzle opening 34, so that the passageway area 40*a* is about one quarter of the nozzle opening 34.

In the intermediate size of FIG. 17, the diameter and cross-sectional area of the passageway 40*b* (indicated at "g") is nearly the same as that of the nozzle 34.

In FIG. 18, the diameter of the passageway 40*c* (indicated at "h") is slightly less than one and one half of the nozzle opening 34, and the cross sectional area is about twice as large.

Figure 9:
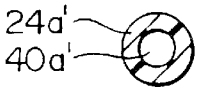
FIGS. 9, 10 and 11 correspond to, respectively, FIGS. 3, 5 and 7 and show a different arrangement of discharge tubes where the outside diameter varies.
Figure 10:
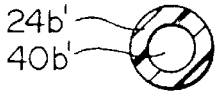
Figure 11:
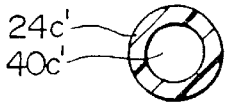

FIGS. 9, 10 and 11 show an alternative form of the tubes 24*a–c*, and these tubes in FIG. 9 through 11 (designated 24*a*', 24*b*' and 24*c*') have the same internal passageway cross-sectional area as the passageways 24*a*, 24*b* and 24*c*, respectively, but the outside diameter of these are made smaller, relative to the passageway size. If there is such varying outside diameters, then a plurality of mounting collars could be used, with these having consistent outside diameters, but varying inside diameters to fit around at least the smaller tubes of FIGS. 9 and 10.

Figure 12:
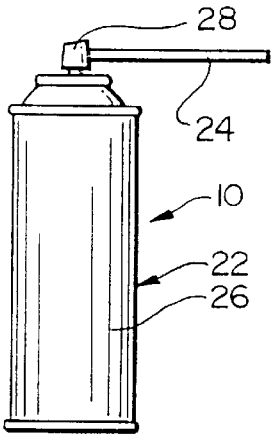
FIGS. 12, 13 and 14 illustrate the apparatus having tubes 24 of different lengths.
Figure 13:
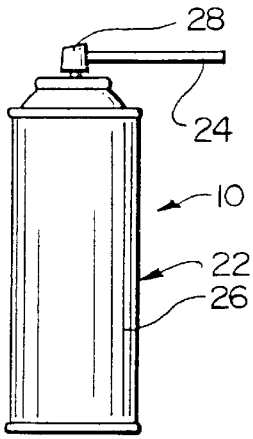
Figure 14:
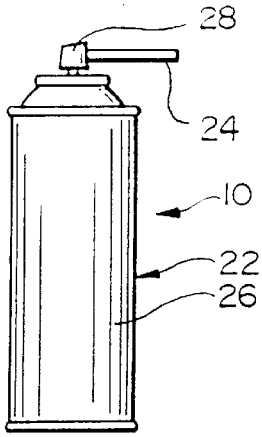

FIGS. 12 through 14 are simply shown to illustrate that the length of the tube 24 can be varied. It has been found that a rather desirable length of the tube 24 is approximately four inches. While a longer tube length could be used, in general there is no particular advantage in doing so since the proper consistency can be obtained with a tube of about four inches. Also, experiments have indicated that the length of the tube 24 can be reduced lower than four inches, possibly to two inches and even as low as one inch) without causing any substantial deterioration of the consistency and quality of the formation of the spray pattern. However, it has been found that somewhat more consistent results can be obtained if the length of the tube 24 is greater than one inch and at least as great or greater than two inches. A tube length as short as one half inch has been tried, and this is able to provide a substantial improvement of performance over what would have been obtained simply by discharging the spray texture directly from the nozzle opening 34, without any tube, relative to controlling spray pattern. The shorter tube 24 (as small as one half inch) provides a significant benefit, but not the full benefit of the longer tube 24. The very short tube (e.g. one half inch) has a lesser quality of performance when used with the larger diameter S passageway 40 than with the smaller passageway.

Figure 15:
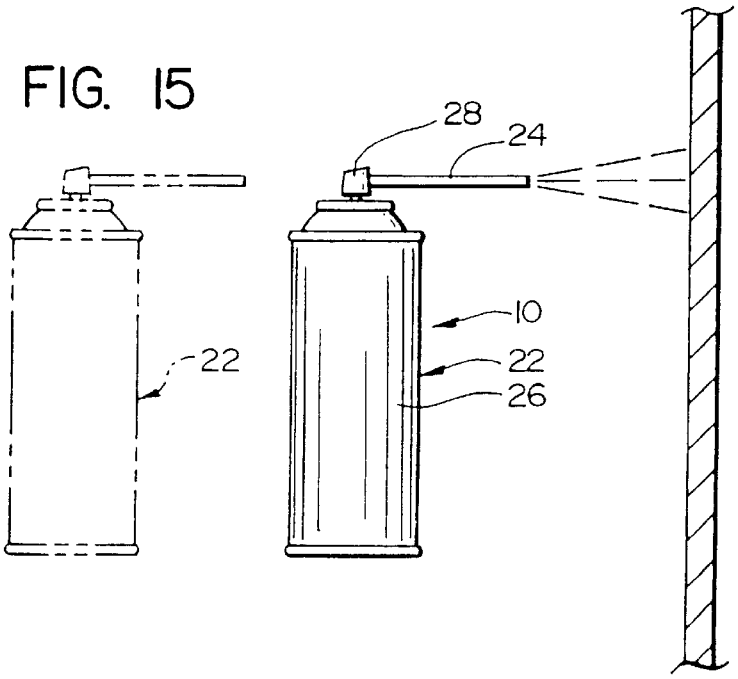
FIG. 15 is a side elevational view of the apparatus as shown being positioned closer to or further from a wall surface.

FIG. 15 illustrates that the texture pattern can also be controlled to some extent by moving the apparatus 10 closer to or farther away from the wall surface. If the apparatus 10 is moved rather close to the wall surface, the density of the applied material is increased for a given time of exposure. It has been found that in general satisfactory results can be obtained if the apparatus 10 is held approximately three feet from the wall surface. However, this will depend upon a number of factors, such as the pressure provided by the propellant, the character of the spray texture material, and other factors.

To describe now the operation of the present invention, an aerosol dispensing device 22 is provided as described previously herein with the spray texture material contained within the can 26 at a desired pressure. As is common with aerosol cans, it is desirable to shake the device 22 for a few seconds prior to depressing the nozzle control member 28.

If a relatively fine texture is desired, then a smaller diameter tube such as at 24*a* is used. For spray texture patterns having larger particle size, the larger diameter tube is used.

The person directs the nozzle opening 34 and the tube 24 toward the wall surface to be sprayed and depresses the nozzle member 28. As the spray texture material is discharged, the container 26 is moved back and forth and is tilted to different angles to spray the desired area. As indicated earlier, it has been found that not only can a "fineness" or "coarseness" (i.e. smaller particle size or larger particle size, respectively) be controlled with reasonable precision by the present invention, but this consistency of the spraying pattern can be maintained throughout the discharge of the great majority of the spray material within the container 26. While these phenomena are not totally understood, it is believed that the following can be reasonably hypothesized to provide at least a partial explanation.

First, the separation of the texture material into particles of smaller or larger size is due in part to the character of the material itself, and also due in part to the way the forces are exerted on the material to tend to break it up into particles. More particularly, it can be hypothesized that if there is a greater shear force tending to separate the particles, it would be expected that there would be a finer pattern.

It is also recognized that when a fluid is moving through a conduit or tube, there is commonly what is called a velocity gradient along a transverse cross section of the flow of material. More precisely, the material immediately adjacent to the wall surface may have a very low velocity or practically no velocity. The adjacent material just a small distance away from the wall will have a somewhat greater velocity, but will still be retarded significantly due to the shear force provided by the material that is closer to the wall surface. As the cross section of the liquid material is analyzed closer toward the center, the shear force becomes less and the velocity becomes more uniform.

With the foregoing in mind, it also has to be recognized that if the Adiameter of the tube or conduit is reduced by one half, the cross-sectional area is reduced by one quarter. Thus, for the smaller tube (i.e. one half diameter) the surface area that provides a retarding force is doubled relative to the volume of flow at the same velocity). This would indicate that for a given cross-sectional segment of the fluid material being discharged, there is relatively greater shear force exerted for the smaller inside diameter tube. This would lead to the conclusion that for the discharge of a given amount of fluid at a certain velocity and at the same pressure, there would be a smaller particle size than if a tube of greater inside diameter were used.

Another phenomenon to be considered is with regard to the pressure which is forcing the textured material out of the tube 24. It can be surmised that if the pressure is greater, the velocity of the material traveling through the tube 24 would be greater, so that the shear forces exerted on the texture material would be greater so that smaller particle sizes would result.

It can be seen in FIG. 16 that the relatively small diameter passageway 40*a* serves as a restriction for the material flowing out the nozzle 34. This would tend to cause the velocity of the material flowing up the stem passageway 32 and out the nozzle opening 34 to decrease to some extent, but to have a relatively higher velocity out the passageway 40*a*. Further, it can be expected that the pressure of the propelling gas in the passageway 40*a* would be somewhat higher than if a larger diameter passageway such as 40*b* or 40*c* were utilized.

Experimental results using different size tubes seem to verify this conclusion.

In FIG. 17, the diameter and cross-sectional area of the passageway 40*b* is nearly the same as that of the nozzle opening 34. Therefore it can be surmised that the velocity and pressure in the passageway 40*b* would be somewhat less than in the passageway 40*a*, this resulting in a somewhat larger particle size, and also a somewhat lower discharge velocity. Experimental results have verified this also.

Finally, with reference to FIG. 18, when the passageway diameter is larger than that of the nozzle opening 34 (as it is with the passageway 40*c*), it can be expected that the fluid discharged from the nozzle 34 would have a lower velocity and that there would be a lower propelling force provided by the propellant. Experimental results have indicated that this results in the coarser particle size.

However, it has to be recognized that while the above hypothesis can be proposed with reasonable justification, there are likely other phenomena involved which the applicants are either not aware of or have not fully evaluated. For example, with the propellant being disbursed in (and presumably dissolved in) the texture composition, it can be surmised that this propellant continues to go out of solution or dispersion into its gaseous form and expand to provide the propellant force, and this continues as the quantity of texture material continues to be reduced. This may also have a desirable effect on the formation of the particles and of the particle size, relative to consistency.

Nevertheless, regardless of the accuracy or correctness of the above explanations, it has been found that the spray pattern (and more particularly the particle size of the spray pattern) can be achieved with greater consistency and within relatively greater limits of particle size, than the prior art devices known to the applicants. Further, the consistency of the spray pattern can be maintained for the discharge of a large proportion of spray texture material from the apparatus 10.

It is to be recognized, of course, that various relative dimensions could be changed without departing from the basic teachings of the present invention. For example, it has been found that with spray texture material of a character which are acceptable in present day use, that a range of tube inside diameters of approximately one half of a tenth of an inch to one and one half tenth of an inch would give a reasonable range of texture spray patterns. However, it can be surmised that tube diameters outside of this range (e.g. one quarter of a tenth of an inch to possibly as high as one quarter of an inch would also provide acceptable texture spray patterns, depending upon a variety of circumstances, such as the viscosity and other characteristics of the spray texture material itself, the discharge pressure, the volumetric rate at which the spray texture material is delivered to the tube 24, and other factors.

Figure 19:
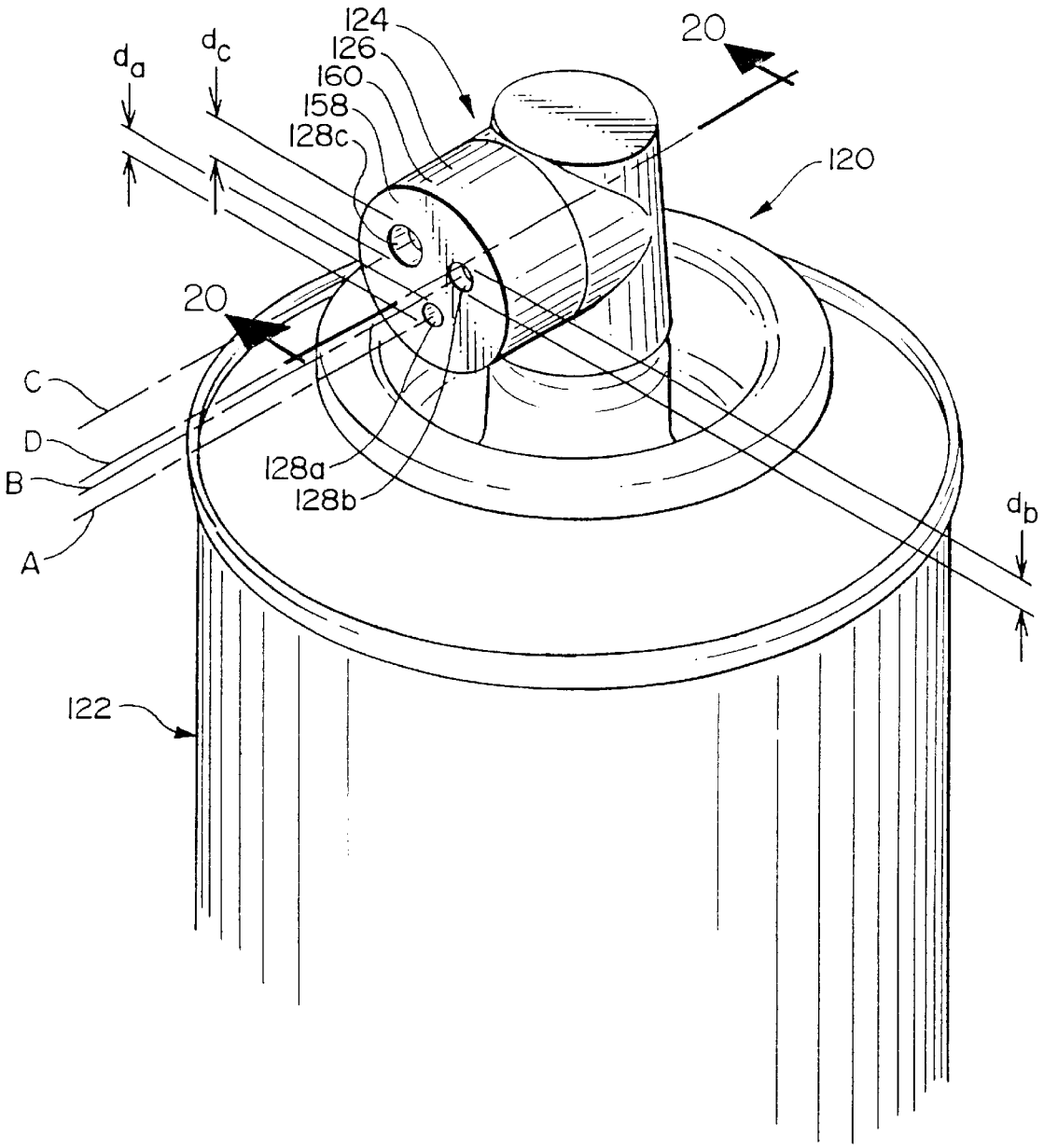
FIG. 19 is a perspective view of another exemplary spray texturing apparatus constructed in accordance with, and embodying, the principles of the present invention.
Figure 20:
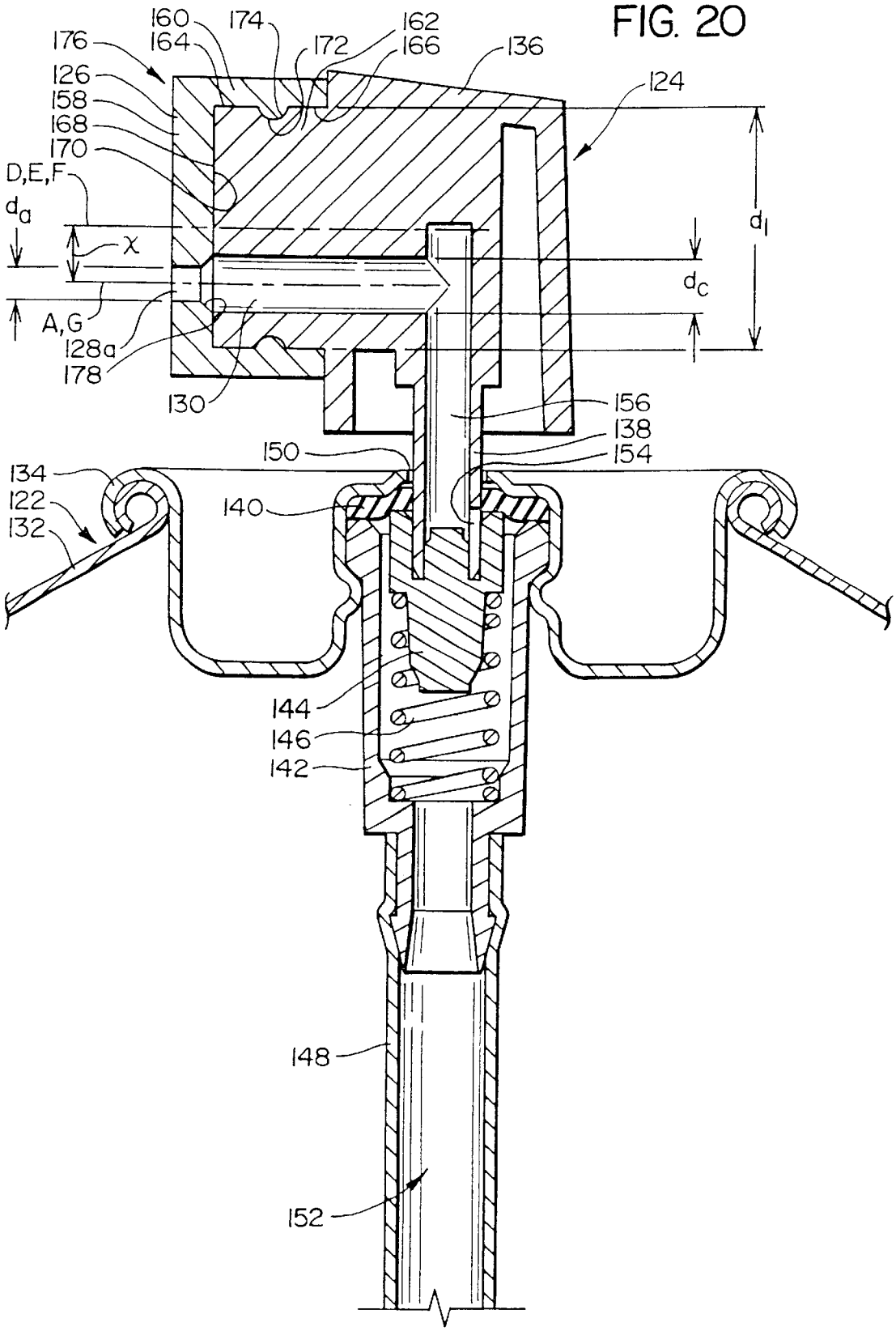
FIG. 20 is a partial cut-away view taken along lines 20—20 in FIG. 19.

Referring now to FIGS. 19 and 20, depicted therein at 120 is another exemplary spray texturing apparatus constructed in accordance with, and embodying, the principles of the present invention. The spray texturing apparatus 120 basically comprises an aerosol container 122, a valve assembly 124 mounted on the container 122, and an outlet member 126 attached to the valve assembly 124.

The outlet member 126 has first, second, and third outlet orifices 128*a*, 128*b*, and 128*c* formed therein. As shown in FIG. 19, these outlet orifices 128*a*, 128*b*, and 128*c* have of different diameters. Further, the outlet member 126 is so attached to the valve assembly 124 that each of the orifices 128*a*, 128*b*, and 128*c* aligned with a nozzle passageway 130 of the valve assembly 124 through which the texture material is dispensed or discharged. Aligning the orifices 128*a*, 128*b*, and 128*c* as just-described effectively extends the length of the nozzle passageway 130 in a manner that allows the operator to vary the cross-sectional area of a discharge opening 131 through which the texture material is discharged.

To operate the spray texturing apparatus 120, the valve assembly 124 is operated to allow the spray material within the container 122 to pass through the nozzle passageway 130. The texture material thus exits the spray texturing apparatus 120 through whichever of the outlet orifices 128*a*, 128*b*, or 128*c* is aligned with the nozzle passageway 130.

Figure 6:
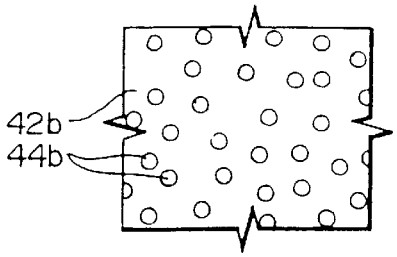

As shown in FIG. 20, the nozzle passageway 130 has a diameter of do. Similar to the dispensing tubes 24*a*, 24*b*, and 24*c* described above, the outlet orifices 128*a*, 128*b*, and 128*c* of different diameters d.sub.*a*, d.sub.*b*, and d.sub.c result in different spray texture patterns 20 being applied to the wallboard 12. One of the outlet orifices 128*a*, 128*b*, and 128*c* is selected according to the type of texture pattern desired and arranged to form a portion of the nozzle passageway 130, thereby varying the effective cross-sectional area of the discharge opening 131. The outlet orifice 128*a* is of the smallest diameter and results in a spray pattern having the small particles 44*a* as shown in FIG. 4. The outlet orifice 128*b* is of medium diameter and results in a spray pattern having the somewhat larger particles 44*b* shown in FIG. 5. The outlet orifice 128*c* is of the largest diameter, which results in a spray pattern having the large particles 44*c* shown in FIG. 6.

The spray texturing apparatus 120 obtains the same basic result as the apparatus 10 described above and the prior art assembly shown in FIGS. 27 and 28; however, as will be apparent from the following discussion, the apparatus 120 allows a reduction in the number of parts employed to achieve this result and substantially eliminates the possibility that individual parts will be lost by the end user. Also, the apparatus 120 is completely assembled at the factory and thus alleviates the potential for the operator to be sprayed with texture material during assembly.

Referring again to FIG. 20, the operation of the spray texturing apparatus 120 will now be described in further detail. The container 122 basically comprises a generally cylindrical base 132 and a cap 134. The base 132 and cap 134 are conventional and need not be described herein in detail.

The valve assembly 124 basically comprises: (a) the outlet member 128 described above; (b) an actuator member 136 having a valve stem 138; (c) a valve seat 140; (d) a valve housing 142; (e) a valve member 144; (f) a valve spring 146; and (g) a collection tube 148 that extends into the spray material within the container 122. Essentially, the valve assembly 124 creates a path that allows the pressure within the container 122 to cause the texture material to flow through the nozzle passageway 130.

The valve assembly 124 is constructed and operates basically as follows. The valve seat 140 and valve housing 142 mate with and are held by the container cap 134 near a valve hole 150 in the cap 134. The valve member 144 and valve spring 146 are mounted within the valve housing 142 such that the valve spring 146 urges the valve member 144 towards the valve seat 140. The valve stem 138 extends through the valve hole 150 and is attached to the valve member 144; pressing the actuator member 136 towards the container 122 into an open position forces the valve member 144 away from the valve seat 140 against the urging of the valve spring 146.

When the valve member 144 is forced away from the valve seat 140, an exit passageway 152 for the spray material is created. This exit passageway 152 allows the spray material to exit the apparatus 120 by passing: through the collection tube 136; through the center of the valve housing 142; around the valve member 144; through a slot 154 formed in the valve stem 138; through a vertical passageway 156 formed in the actuator member 136; through the nozzle passageway 130 described above; and through the one of the outlet orifices 128*a*, 128*b*, or 128*c* aligned with the nozzle passageway 130. At this point, the spray material forms the spray 18 as described above.

The exemplary outlet member 126 basically comprises a disc portion 158 and a cylindrical portion 160. The first, second, and third outlet orifices 128*a*, 128*b*, and 128*c* are formed in the disc portion 158. Center axes A, B, and C of the outlet orifices 128*a*, 128*b*, and 128*c* are equidistant from a center axis D of the disc portion 158; the distances between the center axes A, B, and C of these outlet orifices 128*a*, 128*b*, and 128*c* and the center axis D of the disc portion 158 are represented by the reference character X in FIG. 20.

The cylindrical portion 160 of the outlet member 126 has a center axis E which is aligned with the center axis D of the disc portion 158. Additionally, an outlet portion 162 of the actuator member 126 through which the nozzle passageway 130 extends has a generally cylindrical outer surface 164. A center axis F of the actuator member outer surface 164 is aligned with the center axes D and E described above.

Also, a center axis G of the nozzle passageway 130 is arranged parallel to the center axis F of the actuator member outer surface 164. The center axis G of this nozzle passageway 130 is spaced away from actuator member center axis F the same distance X that exists between the center axes A, B, and C of the nozzle exit orifices and the center axis D of the disc portion 158.

Finally, an inner surface 166 of the outlet member cylindrical portion 160 is cylindrical and has substantially the same diameter d, taking into account tolerances, as the cylindrical outer surface 164 of the outlet portion 162 of the actuator member 136. An outlet surface 168 of the outlet portion 162 is disc-shaped and has substantially the same diameter d as the outlet member inner surface 166 and the actuator member outer surface 164.

Accordingly, as shown in FIG. 20, the outlet member 126 is attached to the actuator member 136 by placing the cylindrical portion 160 of the outlet member 126 over the outlet portion 162 of the actuator member 136 such that the actuator member outlet surface 168 is adjacent to an inner surface 170 on the disc portion 158 of the outlet member 126.

When the outlet member 126 is so mounted on the actuator member 136, an annular projection 172 formed on the inner surface 166 of the outlet member cylindrical portion 160 engages an annular indentation 174 formed in the outer surface 164 of the actuator member outlet portion 162. The projection 172 and indentation 174 are arranged parallel to the actuator member outlet surface 168 and thus allow rotation of the outlet member 126 relative to the actuator member 136.

Further, the engagement of the projection 172 with the indentation 174 prevents inadvertent removal of the outlet member 126 from the actuator member 136; however, both the projection 172 and indentation 174 are rounded to allow the outlet member 126 to be attached to and detached from the actuator member 136 when desired. The outlet member cylindrical portion 160, the projection 172, and indentation 174 thus form an attachment means 176 for rotatably attaching the outlet member 126 to the actuator member 136.

As shown in FIG. 20, when the outlet member 126 is attached to the actuator member 136, the center axes D, E, and F described above are aligned. Further, the outlet orifice center axes A, B, and C are parallel to the nozzle passageway center axis G. Accordingly, any one of these outlet orifice center axes A, B, and C can be aligned with the nozzle passageway center axis G by rotation of the outlet member 26 about the axes D, E, and F relative to the actuator member 136. In FIG. 20, the center axis A of the first outlet orifice 128*a* is shown aligned with the nozzle passageway center axis G.

FIG. 20 also shows that an intermediate surface 178 is formed at one end of the first exit orifice 128*a*. This intermediate surface 176 brings the diameter of the exit passageway 152 gradually down from a diameter do of the dispensing passageway 130 to the diameter da Of the first exit orifice 128*a*. A similar intermediate surface exists at one end of the second exit orifice 128*b*. An intermediate surface is not required for the third exit orifice 128*c* as, in the exemplary apparatus 120, the diameter d.sub.c of the third exit orifice is the same as that of the diameter do of the nozzle passageway 130.

Figure 21:
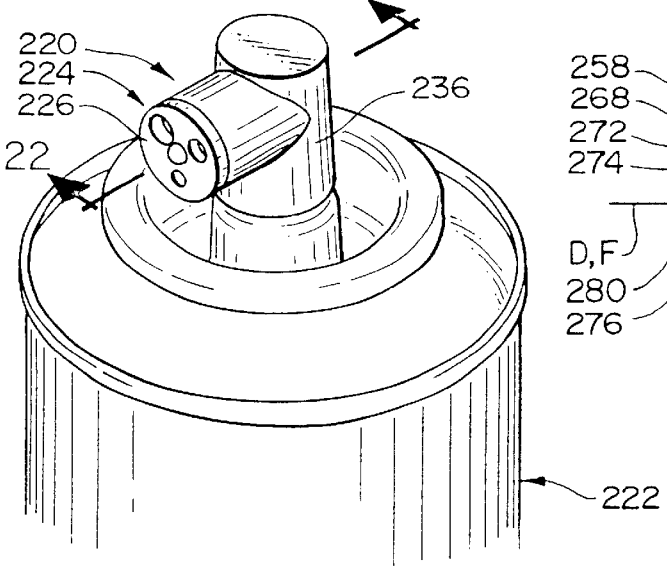
FIG. 21 is a perspective view of another exemplary spray texturing apparatus constructed in accordance with, and embodying, the principles of the present invention.
Figure 22:
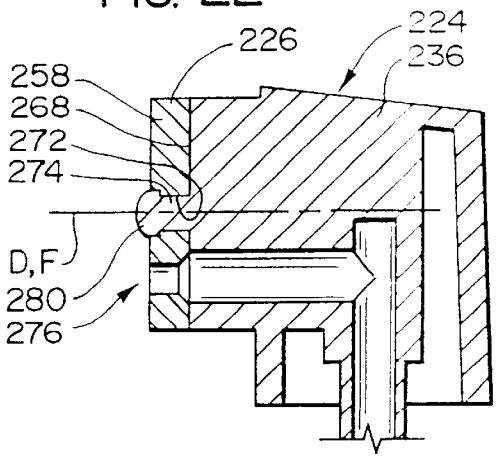
FIG. 22 is a partial cut-away view taken along lines 22—22 in FIG. 21.

Referring now to FIGS. 21 and 22, depicted therein at 220 is yet another exemplary spray texturing apparatus constructed in accordance with, and embodying, the principles of the present invention. The spray texturing apparatus 220 operates in the same basic manner as the apparatus 120 just-described; accordingly, the apparatus 220 will be described herein only to the extent that it differs from the apparatus 120. The characters employed in reference to the apparatus 220 will be the same as those employed in reference to the apparatus 120 plus 100; where any reference characters are skipped in the following discussion, the elements referred to by those skipped reference characters are exactly the same in the apparatus 220 as the elements corresponding thereto in the apparatus 120.

The spray texturing apparatus 220 basically comprises an aerosol container 222, a valve assembly 224 mounted on the container 222, and an outlet member 226 attached to the valve assembly 224. The valve assembly 224 further comprises an actuator member 236. The primary difference between the apparatus 120 and the apparatus 220 is in the construction of the outlet member 226 and the actuator member 236 and the manner in which these members 226 and 236 inter-operate.

In particular, the outlet member 226 simply comprises a disc portion 258. An attachment means 276 for attaching the outlet member 226 to the actuator member 236 basically comprises an indentation or hole 272 formed in the outlet member disc portion 258 and a projection 274 formed on an outlet surface 268 formed on the actuator member 236. The hole 272 and projection 274 lie along a center axis D of the disc portion 258 and a center axis F extending through the actuator member 236. The interaction of the hole 272 and the projection 274 allow the outlet member 226 to be rotated about the axes D and F. A rounded end 280 of the projection 274 prevents inadvertent removal of the outlet member 226 from the actuator member 236.

Accordingly, it should be clear from the foregoing discussion and FIGS. 21 and 22 that the attachment means 276 accomplishes the same basic function as the attachment means 176 described above and thus that the apparatus 220 operates in the same basic manner as the apparatus 120 described above.

Figure 23:
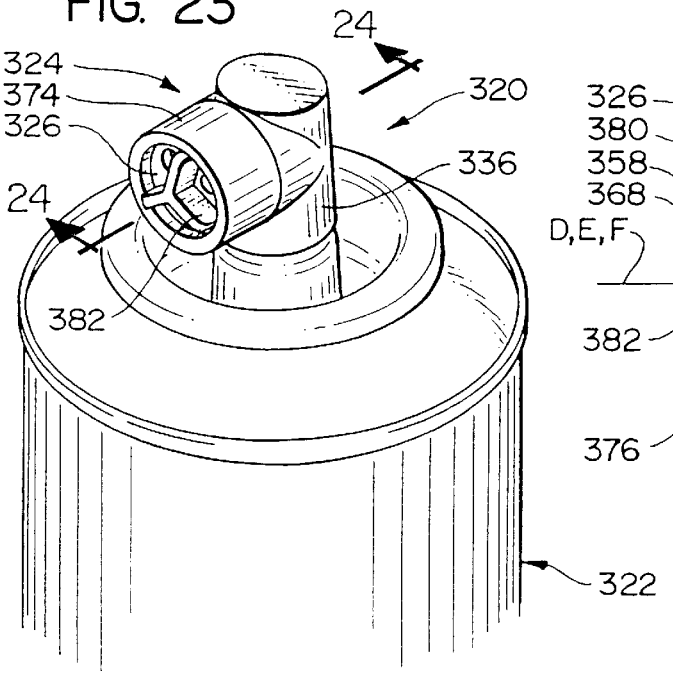
FIG. 23 is a perspective view of another exemplary spray texturing apparatus constructed in accordance with, and embodying, the principles of the present invention.
Figure 24:
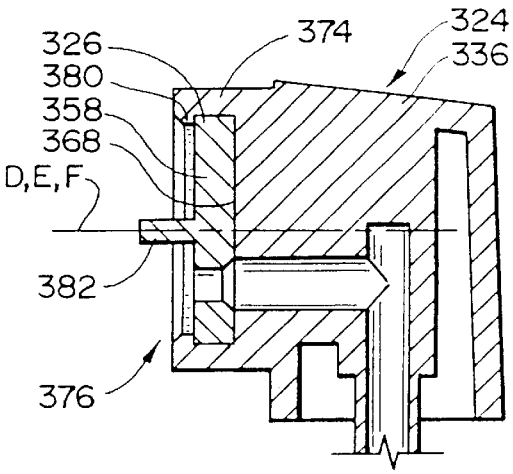
FIG. 24 is a partial cut-away view taken along lines 24—24 in FIG. 23.

Referring now to FIGS. 23 and 24, depicted therein at 320 is yet another exemplary spray texturing apparatus constructed in accordance with, and embodying, the principles of the present invention. The spray texturing apparatus 320 operates in the same basic manner as the apparatus 120 described above; accordingly, the apparatus 320 will be described herein only to the extent that it differs from the apparatus 120. The characters employed in reference to the apparatus 320 will be the same as those employed in reference to the apparatus 120 plus 200; where any reference characters are skipped in the following discussion, the elements referred to by those skipped reference characters are exactly the same in the apparatus 320 as the elements corresponding thereto in the apparatus 120.

The spray texturing apparatus 320 basically comprises an aerosol container 322, a valve assembly 324 mounted on the container 322, and an outlet member 326 attached to the valve assembly 324. The valve assembly 324 further comprises an actuator member 336. The primary difference between the apparatus 120 and the apparatus 320 is in the construction of the outlet member 326 and the actuator member 336 and the manner in which these members 326 and 336 inter-operate.

In particular, the outlet member 326 simply comprises a disc portion 358. An attachment means 376 for attaching the outlet member 326 to the actuator member 336 basically an annular ring 374 having a center axis E fastened to the actuator member 236. An annular projection 380 extends inwardly from the ring 374. The diameter of the disc portion 358 is substantially the same as that of the ring 374, taking into account tolerances, and slightly larger than that of the projection 380.

The outlet member 326 is attached to the actuator member 336 by placing the outlet member 326 within the ring 374 and attaching the ring 374 onto the actuator member 336 with: (a) the outlet member 326 between the annular projection 380 and an outlet surface 368 of the actuator member 336; and (b) a center axis D of the disc member 358 aligned with the axis E of the ring 374 and a center axis F of the actuator member 336. The outlet member 326 can rotate within the ring 374 about the axes D, E, and F, and the annular projection 380 prevents inadvertent removal of the outlet member 326 from the actuator member 336. A handle 382 is provided on the outlet member 326 to facilitate rotation outlet member 326.

The attachment means 376 accomplishes the same basic function as the attachment means 176 described above. The apparatus 320 thus operates in all other respects in the same basic manner as the apparatus 120 described above.

Figure 25:
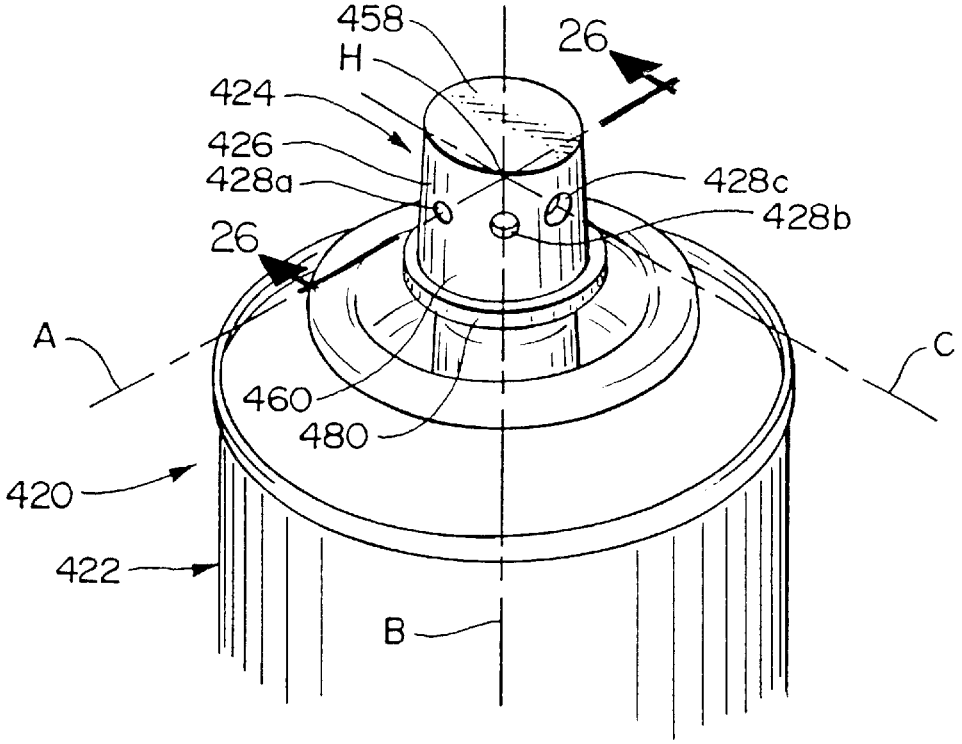
FIG. 25 is a perspective view of another exemplary spray texturing apparatus constructed in accordance with, and embodying, the principles of the present invention.
Figure 26:
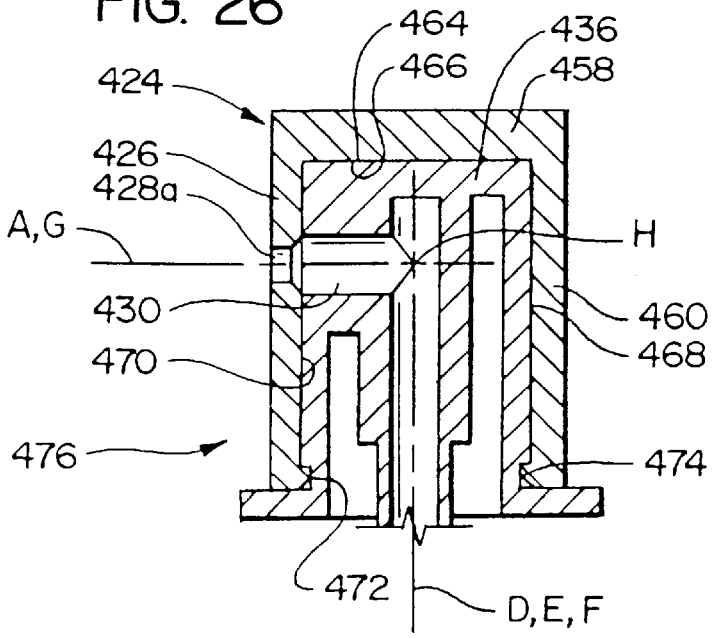
FIG. 26 is a partial cut-away view taken along lines 26—26 in FIG. 25.

Referring now to FIGS. 25 and 26, depicted therein at 420 is yet another exemplary spray texturing apparatus constructed in accordance with, and embodying, the principles of the present invention. The spray texturing apparatus 420 operates in the same basic manner as the apparatus 120 described above; accordingly, the apparatus 420 will be described herein only to the extent that it differs from the apparatus 120. The characters employed in reference to the apparatus 420 will be the same as those employed in reference to the apparatus 120 plus 300; where any reference characters are skipped in the following discussion, the elements referred to by those skipped reference characters are exactly the same in the apparatus 420 as the elements corresponding thereto in the apparatus 120.

The spray texturing apparatus 420 basically comprises an aerosol container 422, a valve assembly 424 mounted on the container 422, and an outlet member 426 attached to the valve assembly 424. The valve assembly 424 further comprises an actuator member 436. The primary difference between the apparatus 120 and the apparatus 420 is in the construction of the outlet member 426 and the actuator member 436 and the manner in which these members 426 and 436 inter-operate.

In particular, the outlet member 426 comprises a disc portion 458 having a lower surface 466 and a cylindrical portion 460 having an inner surface 470. In the exemplary apparatus 420, the actuator member 436 has an upper surface 464 and a cylindrical outer surface 468. When the valve assembly 424 is assembled, a center axis D of the disc portion 458, a center axis E of the cylindrical portion 460, and a vertical center axis F of the stem portion 436 are aligned.

An attachment means 476 for attaching the outlet member 426 to the actuator member 436 basically comprises an annular ring 472 formed on the outlet member cylindrical portion 460 and a notch or indentation 474 formed around the cylindrical outer surface 468 of the actuator member 436. This attachment means 476 allows the outlet member 426 to rotate relative to the actuator member 436 about the axes D, E, and F but prevents inadvertent removal of the outlet member 426 from the actuator member 436.

With this configuration, the first, second, and third outlet orifices 428*a*, 428*b*, and 428*c* are formed in the cylindrical portion 460 of the outlet member 426. These orifices 428*a*, 428*b*, and 428*c* are formed with their center axes A, B, and C orthogonal to, arranged at a given vertical point H along, and radially extending outwardly from the vertical center axis F of the stem portion 436. A center axis G of a nozzle passageway 430 formed in the actuator member 436 also is orthogonal to, radially extends from, and intersects at the given point H the vertical center axis F of the stem portion 436.

To facilitate rotation of the outlet member 426 relative to the actuator member 436, a peripheral flange 480 is formed at the bottom of the actuator member 436. The user can grasp this flange 480 to hold the actuator member 436 in place as the outlet member 426 is being rotated about its axis D. Thus, rotation of the outlet member 426 relative to the actuator member 436 about the axes D, E, and F allows any one of these orifices 428*a*, 428*b*, and 428*c* to be aligned with a center axis G of a nozzle passageway 430 formed in the actuator member 436. The first outlet orifice 428*a* is shown aligned with the nozzle passageway 430 in FIG. 26.

The attachment means 476 thus also accomplishes the same basic function as the attachment means 176 described above. Accordingly, the apparatus 420 operates in all other respects in the same basic manner as the apparatus 120 described above.

Referring now to FIGS. 27, 28, 29, and 30, depicted therein at 520 is another exemplary spray texturing apparatus constructed in accordance with, and embodying, the principles of the present invention. The spray texturing apparatus 520 operates in the same basic manner as the apparatus 120 described above; accordingly, the apparatus 520 will be described herein only to the extent that it differs from the apparatus 120. The characters employed in reference to the apparatus 520 will be the same as those employed in reference to the apparatus 120 plus 400; where any reference characters are skipped in the following discussion, the elements referred to by those skipped reference characters are exactly the same in the apparatus 420 as the elements corresponding thereto in the apparatus 120.

The spray texturing apparatus 520 basically comprises an aerosol container 522, a valve assembly 524 mounted on the container 522, and an outlet member 526 attached to the valve assembly 524. The valve assembly 524 further comprises an actuator member 536. The primary difference between the apparatus 120 and the apparatus 520 is in the construction of the outlet member 526 and the actuator member 536 and the manner in which these members 526 and 536 inter-operate.

In particular, in the apparatus 520 a nozzle passageway 530 formed in the actuator member 536 terminates at the top rather than the side of the actuator member 536. The outlet member 526 comprises a disc member 558 attached to an outlet surface 568 on the upper end of the actuator member 536. A hole 572 formed in the disc member 558 and a projection 574 formed on the outlet surface 568 comprise an attachment means 576 for attaching the outlet member 526 onto the actuator member 536.

The attachment means 576 allows the outlet member 526 to be rotated about a center axis D thereof relative to the actuator member 536 such that any one of the center axes A, B, or C of outlet orifices 528*a*, 528*b*, and 528*c* can be aligned with a center axis G of the nozzle passageway 520.

Finger engaging wings 580 and 582 are formed on the actuator member 536 to allow the user to depress the actuator member 536 and spray the texture material within the container without getting texture material on the fingers.

The nozzle passageway identified by the reference character 530*a* in FIG. 28 comprises a dog-leg portion 584 that allows a center axis G of the nozzle passageway 530*a* to be offset from a vertical center axis F of the stem portion 536 and the center axis D of the outlet member 526. In FIG. 30, the nozzle passageway 530*b* is straight and the center axis D of the outlet member 526 is offset from the vertical center axis F of the stem portion 536. In this case, the disc member 558*b* forming the outlet member 526 in FIGS. 29 and 30 has a larger diameter than does the disc member 558*a* forming the outlet member 526 in FIGS. 27 and 28.

Referring now to FIGS. 31A and B, depicted at 600 therein is an aerosol device constructed in accordance with, and embodying, the principals of the present invention. The device 600 basically comprises an aerosol assembly 602 and an outlet assembly 604. The aerosol assembly 602 is conventional and will be described below only briefly.

The aerosol assembly 602 comprises a container 606, a valve assembly 608, and an actuator member 610. As is well known in the art, depressing the actuator member 610 moves the valve assembly 608 into its open position in which an exit passageway is defined from the interior to the exterior of the container 606. This exit passageway terminates in a nozzle opening 612 formed in the actuator member 610.

The outlet assembly 604 comprises a straw 614 and one or more constricting members 616. The straw member 614 is adapted to fit into the nozzle opening 612 such that texture material exiting the aerosol portion 602 passes through a discharge opening 618 defined by the straw 614.

The restricting sleeves 616 are adapted to fit onto the straw 614. Additionally, as shown in FIG. 31 B, each of the constricting sleeves defines a sleeve passageway 620 into which the straw 614 is inserted. The sleeve passageways 620 each comprise a reduced diameter portion 622. The straw 614 is made out of flexible material such that, when the straw is inserted into the sleeve passageway 620, the reduced diameter portions 622 of the passageway 620 act on the straws 614 to create outlet portions 624 of the dispensing passageway 618 having different cross-sectional areas. Each of the outlet portions 624*a*, 624*b*, 624*c* defined as described above corresponds to a different texture pattern.

The outlet assembly 604 as described above thus results in at least four different texture patterns. One is formed by the straw 614 without any constricting sleeve mounted thereon, and three are formed by the different constricting sleeves 616*a*, 616*b*, and 616*c* shown in FIG. 31B.

Also, as shown in FIG. 31A, the constricting sleeve 616 may be mounted on the end of the straw 614 as shown by solid lines or at a central location along the length of the straw 614 as shown by broken lines.

The aerosol device 600 thus employs an elongate discharge opening as formed by the straw 614 and provides constricting sleeves 616 that allow a cross-sectional area of the discharge opening 618 to be reduced, thereby allowing the device 600 to dispense texture material in a manner that forms different texture patterns.

Referring now to FIG. 32, depicted therein is an alternate outlet assembly 626 that may be used in place of the outlet assembly 604 described above. The outlet assembly 626 comprises a straw 628 and a constricting disc 630. The straw 628 functions in a manner essentially the same as the straw 614 described above. The disc 630 defines three disc passageways 632*a*, 632*b*, and 632*c* which function in the same basic manner as the passageways 620*a*, 620*b*, and 620*c* described above.

The single constricting disc 630 thus performs essentially the same function as the three constricting sleeves 616*a*, 616*b*, and 616*c* described above. A possible advantage to the outlet portion 626 is that it requires the fabrication and storage of only two parts (the straw 628 and the disc 630) rather than four parts (the straw 614 and the constricting sleeves 616*a*, 616*b*, and 616c).

Referring now to FIGS. 33A and 33B, depicted therein is yet another outlet assembly 634 that may be used instead of the outlet assembly 604 described above.

The outlet assembly 634 comprises a straw 636 and one or more constricting plugs 638. The straw 636 is essentially the same as the straw 614 described above, although the straw 636 is preferably made out of more rigid material than that from which the straw 614 is made.

The straw 636 and plugs 638 define a discharge passageway 640 through which texture material must pass as it exits the aerosol portion 602. The discharge passageway 640 comprises an outlet portion 642 defined by a central bore 644 formed in the plugs 638. As shown in FIG. 33B, the plugs 642*a*, 642*b*, and 642*c* have bores 644*a*, 644*b*, and 644*c* of different cross-sectional areas. As the outlet portions 642*a*, 642*b*, and 642*c* of the exit passageway 640 are defined by the bores 644*a*, 644*b*, and 644*c*, these outlet portions also have different cross-sectional areas. The constricting plugs 638*a*, 638*b*, and 638*c* are mounted on the straw 636 in a manner that allows the outlet portion 634 to be reconfigured to define an exit passageway at least a portion of which can be increased or decreased. This allows the outlet portion 634 to cause the texture material to be deposited on a surface in different patterns.

A number of mechanisms can be employed to mount the constricting plugs 638 on to the straw 636. The exemplary configuration shown in FIGS. 33A and 33B employs a reduced diameter portion 646 adapted to fit snugly within a central bore 648 defined by the straw 636. The tolerances of the reduced diameter portion 646 and the walls defining the bore 648, along with the material from which the straw 636 and plug 638 are made, result in a friction fit that holds the constricting plug within the straw 636 as shown in FIGS. 33A and 33B.

An external flange 650 is formed on each of the constricting plugs 638 primarily to facilitate removal of these plugs 638 from the straw 636 when different spray texture patterns are required.

Figure 34A:
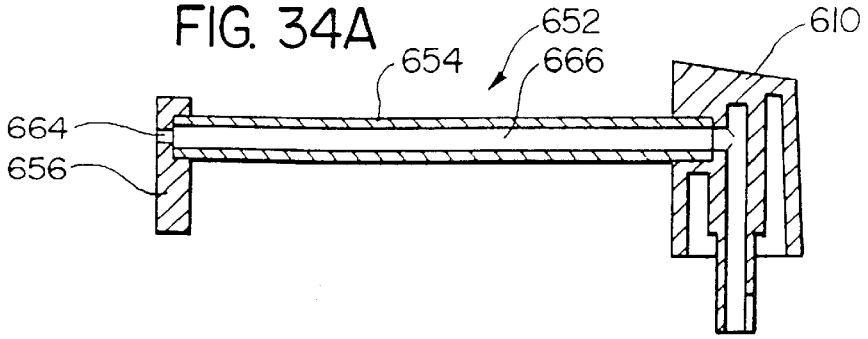
FIG. 34A is a section view depicting yet another exemplary discharge assembly constructed in accordance with the present invention.
Figure 34B:
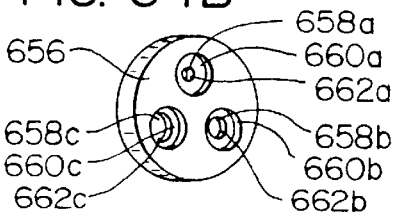
FIG. 34B is a perspective view showing one component of the discharge assembly shown in FIG. 34A.

Referring now to FIGS. 34A and 34B, depicted therein is yet another exemplary method of implementing the principles of the present invention. In particular, shown in FIG. 34A is yet another outlet assembly 652 adapted to be mounted on the aerosol assembly 602 in place of the outlet assembly 604 shown above.

In particular, the outlet assembly 652 comprises a straw 654 and a constricting disc 656. The straw 654 is mounted onto the actuator member 610, and the constricting disc 656 is mounted on a distal end of the straw 654.

The straw 654 is similar in shape to the straw 614 described above and it is similar in both shape and function to the straw 636 described above. In particular, the straw 654 is made out of semi-rigid material that allows a pressure fit to be formed that will mechanically engage the straw 654 both to the actuator member 610 and to the constricting disc 656.

Referring now to FIG. 34B, it can be seen that the constricting disc 656 has three holes 658*a*, 658*b*, and 658*c* formed therein. These holes 658 have a wide diameter portion 660 and a reduced diameter portion 662. As perhaps best shown in FIG. 34A, the wide diameter portion is sized and dimensioned to receive the straw 654 to form a pressure fit that mounts the disc 656 onto the straw 654 in a manner that prevents inadvertent removal of the disc 656 from the straw 654, but allows the disc 656 to be manally removed from the straw 654 when a different spray texture pattern is desired.

The reduced diameter portion 662 define an outlet portion 664 of a discharge passageway 666 defined by the outlet portion 652. As can be seen from FIG. 34B, each of the reduced diameter portions 662 has a different cross-sectional are*a*, resulting in a different cross-sectional area of the outlet portion 664.

The embodiment of the present invention shown in FIGS. 34A and FIG. 34B thus allows the formation of different texture patterns as described in more detail above.

Figure 35:
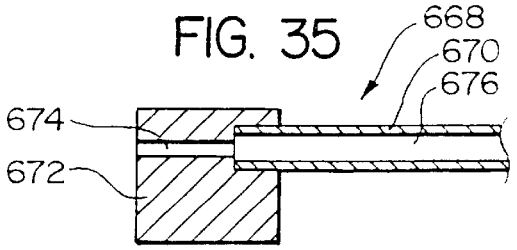
FIG. 35 is a section view showing yet another discharge assembly constructed in accordance with the present invention.

Referring now to FIG. 35, depicted therein is yet another outlet portion 668 constructed in accordance with, and embodying, the principles of the present invention. This outlet portion 668 is similar to the portion 652 described above. The outlet portion 668 comprises a straw 670 that can be the same as the straw 654 described above and a constricting cylinder 672. The constricting cylinder 672 is in many respects similar to the constricting disc 656 described above; the cylinder 672 has three holes formed therein, each having a large diameter portion adapted to form a pressure fit with the straw 670 and a reduced diameter portion for allowing a cross-sectional area of an outlet portion 674 of an exit passageway 676 to be selected. The primary difference between the cylinder 672 and the disc 656 is that the outlet portion 674 of the exit passageway 676 is elongated.

Figure 36A:
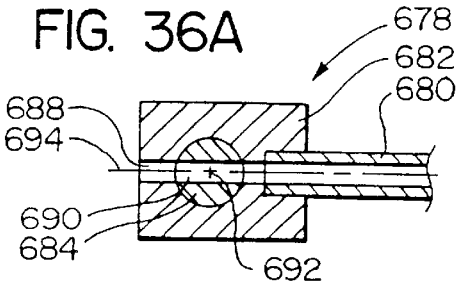
FIGS. 36A and 36B are section views showing yet another exemplary embodiment of a discharge assembly constructed in accordance with the principles of the present invention.
Figure 36B:
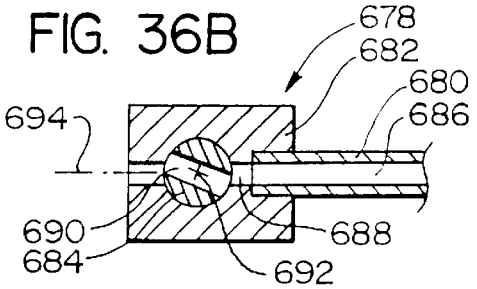

Referring now to FIGS. 36A and 36B, depicted therein is yet another exemplary embodiment of the present invention. In particular, FIGS. 36A and 36B depict yet another exemplary outlet assembly 678 adapted to be mounted onto an aerosol assembly such as the aerosol assembly 602 described above.

The outlet assembly 678 comprises a straw 680, a fixed member 682, and a movable member 684. The exit portion 678 defines a discharge passageway 686 that extends through the straw 680 and is defined by a first bore 688 defined by the fixed member 682 and a second bore 690 defined by the movable member 684.

The fixed member 682 is mounted onto the end of the straw 680 using a pressure fit established in a manner similar to that formed between the cylindrical member 672 and straw 670 described above. The movable member 684 is mounted within the fixed member 682 such that the movable member 684 may be rotated about an axis 692 transverse to a dispensing axis 694 defined by the discharge passageway 686.

As shown by a comparison of FIGS. 36A and 36B, rotation of the movable member, 684 relative to the fixed member 682 can alter an effective cross-sectional area of the discharge passageway 686. By altering the discharge passageway in this manner, different texture patterns may be formed by the texture material being discharged through the discharge passageway 686. Rather than providing a plurality of discrete cross-sectional areas, the outlet portion 678 allows a continuous variation in the size of the cross-sectional area of the exit passageway 686. It should be noted that the discharge passageway 686 may be closed.

Figure 37A:
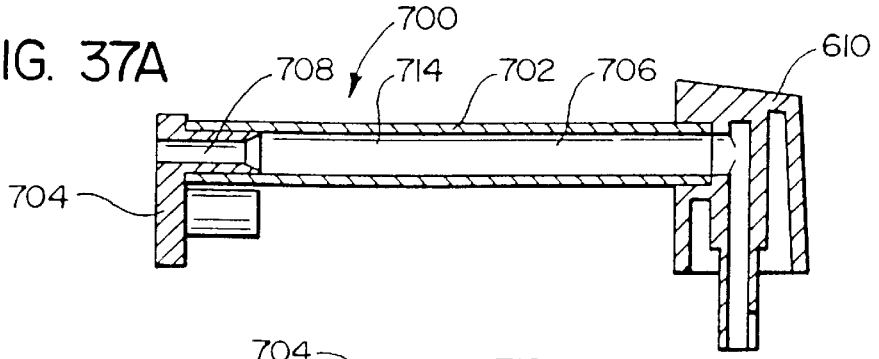
FIG. 37A is a section view showing still another exemplary discharge assembly constructed in accordance with the present invention.
Figure 37B:
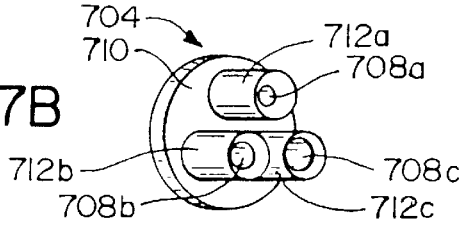
FIG. 37B is a perspective view showing one member of the assembly shown in FIG. 37A.

Referring now to FIGS. 37A and 37B, depicted therein is yet another example of a device incorporating the principles of the present invention. In particular, depicted in FIG. 37A is yet another discharge assembly 700 adapted to be mounted onto the actuator member 610 of the aerosol assembly 602.

The discharge assembly 700 comprises a straw 702 and a plug disc 704. The outlet portion 700 includes a discharge passageway 706 defined in part by the straw 702 and in part by one of a plurality of bores 708 formed in the plug disc 704. In particular, as shown in FIG. 37B the plug disc 704 comprises a disc portion 710 and three plug portions 712*a*, 712*b*, and 712c. The bores 708 extend through the plug portions 712. The plug portions 712 extend into a bore 714 defined by the straw 702 and form a pressure fit with the straw 702 that prevents inadvertent removal of the plug disc 704 from the straw 702 but allow the plug disc 704 to be manually removed when different spray texture patterns are desired.

Figure 38A:
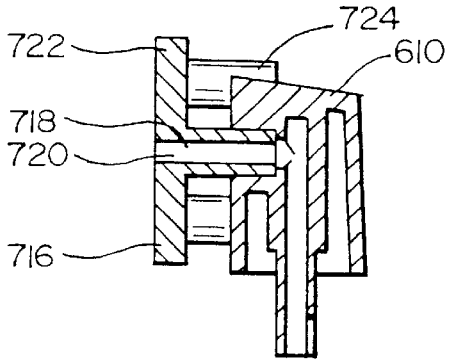
FIG. 38A is a section view of yet another exemplary discharge assembly.
Figure 38B:
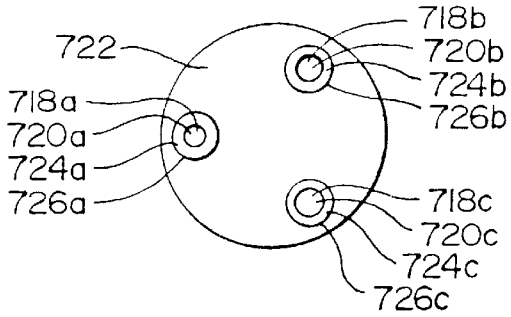
FIG. 38B is a front view of one of the components of the discharge assembly shown in FIG. 38A.

Referring now to FIGS. 38A and 38B, depicted therein is yet another device embodying the principles of the present invention. In particular, shown therein is an outlet member 716 adapted to be substituted for the outlet assembly 704 described above. The outlet member 716 is similar in construction and operation to the plug disc 704 described above. But the outlet member 716 is adapted to connect directly onto the actuator member 610 of the aerosol portion 602. The system shown in FIGS. 38A and 38B thus does not include a straw; a plurality of discharge passageways 718 are entirely formed by bores 720 formed in the discharge member 716.

As shown in FIG. 38B, the cross-sectional area of these bores 720*a*, 720*b*, and 720*c* are different, resulting in discharge passageways 718*a*, 718*b*, and 718*c* having different cross-sectional areas.

The discharge member 716 comprises a plate portion 722 and a plurality of plug portions 724 extending therefrom. The bores 720 extend through the plugs 724, and outer surfaces 726 of the plugs are adapted to fit within the actuator member 610 such that texture material leaving the aerosol portion 602 passes through the discharge passageway 718 defined by one of the bores 720. A selected one of the plugs 724 is inserted into the actuator member 610 depending on the texture pattern desired.

The embodiment shown in FIGS. 38A and 38B discloses a simple method of obtaining a plurality of texture patterns and includes a somewhat elongated discharge passageway.

Figure 39A:
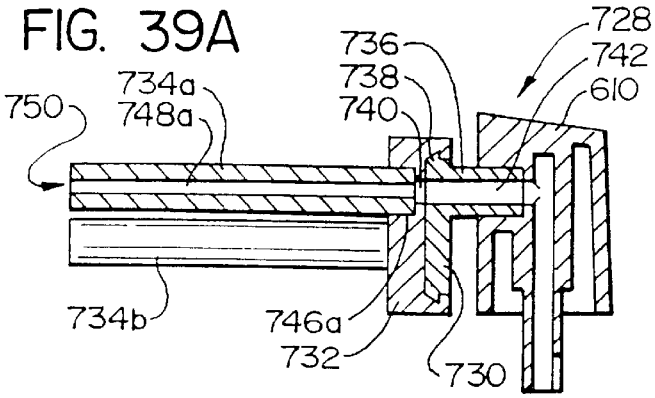
FIG. 39A is a section view showing yet another exemplary discharge assembly constructed in accordance with the present invention.
Figure 39B:
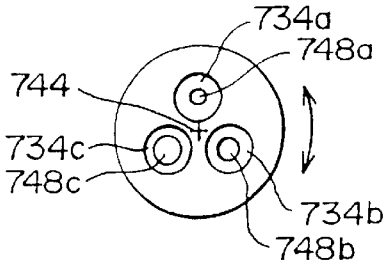
FIG. 39B is a front view showing one component of the discharge assembly shown in FIG. 39A.

Referring now to FIGS. 39A and 39B, depicted therein is yet another outlet assembly 728 adapted to be mounted onto the actuator member 610 of the aerosol device 602.

The outlet assembly 728 comprises a fixed member 730, a rotatable member 732, and a plurality of straws 734. The fixed member 730 has a plug portion 736 adapted to form a pressure fit with the actuator member 610 and a plate portion 738. The rotatable member 732 comprises a cavity adapted to mate with the plate portion 738 of the fixed member 730 such that a plurality of bores 740 in the movable member 732 may be brought into alignment with a bore 742 formed in the plug portion 736. This is accomplished by rotating the movable member 732 about an axis 744 relative to the fixed member 730. Detents or other registration means can be provided to positively lock the movable member 732 relative to the fixed member 730 when the bores 740 are in alignment with the bore 742.

Each of the bores 740 has an increased diameter portion 746 sized and dimensioned to receive one of the straws 734. Each of the straws 734 has an internal bore 748.

Texture material exiting the aerosol device 602 passes through a discharge passageway 750 formed by the bores 742, 740, and 748. additionally, as perhaps best shown by FIG. 39B, each of the bores 748*a*, 748*b*, and 748*c* defined by the straws 734*a*, 734*b*, and 734*c* has a different bore cross-sectional area. Accordingly, by rotating the movable member 732 relative to the fixed member 730, a different one of the bores 748*a*, 748*b*, and 748*c* can be arranged to form a part of the discharge passageway 750. Thus, the outlet portion 728 allows the use of a plurality of straws, but does not require any of these straws to be removed and stored while one of the straws is in use.

The outlet portion 728 otherwise allows the selection of one of a plurality of texture patterns and does so using an elongate discharge passageway to provide the benefits described above.

Figure 40:
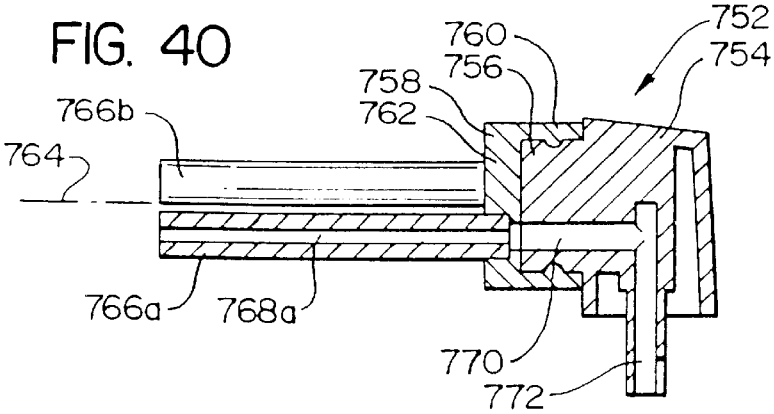
FIG. 40 is a section view of yet another exemplary discharge assembly constructed in accordance with the present invention.

Referring now to FIG. 40, depicted therein is yet another exemplary discharge assembly 752 constructed in accordance with, and embodying the principles of the present invention. The discharge assembly 752 is adapted to be mounted on a modified actuator member 754. The actuator member 754 is similar to the actuator member 610 described above except that the member 754 comprises a cylindrical projection 756 formed thereon. The cylindrical projection 756 functions in a manner substantially similar to the fixed member &30 described above, but is integrally formed with the actuator member 754 to eliminate one part from the overall assembly. The discharge portion 752 comprises a cap 758 having a hollow cylindrical portion 760 and a plate portion 762. The cylindrical portion 760 is adapted to mate with the cylindrical portion 756 such that the cap 758 rotates about an axis 764 relative to the actuator member 754. Extending from the plate portion 762 is a plurality of straws 766.

By rotating the cap 758 about the axis 764, bores 768 of the straws 766 may be brought into registration with a portion 770 of an exit passageway 772. The portion 770 of the exit passageway 772 extends through the cylindrical portion 756.

Additionally, each of the bores 768 has a different cross-sectional area. A desired texture pattern may be selected by placing one of the straws 768 in registration with the passageway portion 770. The overall effect is somewhat similar to that of the discharge portion 728. While the discharge portion 752 eliminates one part as compared to the discharge portion 728, the discharge portion 752 requires a specially made actuator member. In contrast, the discharge portion 728 uses a standard actuator member.

Figure 41:
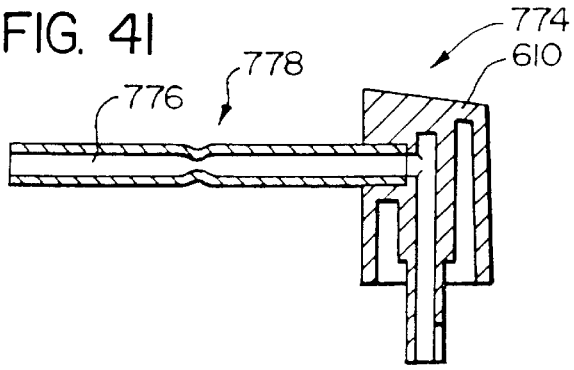
FIG. 41 depicts a discharge member constructed in accordance with the present invention.

Referring now to FIG. 41, depicted therein is yet another discharge member 774 adapted to be mounted on the actuator member 610. This system shown in FIG. 42 is very similar to the system described above with reference to FIGS. 1–18 in that, normally, a plurality of discharge members 774 will be sold with the aerosol portion 602, each straw corresponding to a different texture pattern.

But with the discharge members or straws 774, a bore 776 of each of the straws 774 will have the same cross-sectional area except at one location identified by reference character 778 in FIG. 41. At this location 778, the straw 774 is pinched or otherwise distorted such that, at that location 778, the cross-sectional area of the bore 776 is different for each of the straws. While the location 778 is shown approximately at the middle of the straw 774, this location may be moved out towards the distal end of the straw 774 to obtain an effect similar to that shown and described in relation to FIG. 31 B.

The system shown in FIG. 41 allows the manufacturer of the device to purchase one single size of straw and modify the standard straws to obtain straws that yield desirable texture patterns. This configuration may also be incorporated in a product where the end user forms the distortion 778 to match a preexisting pattern.

Figure 42A:
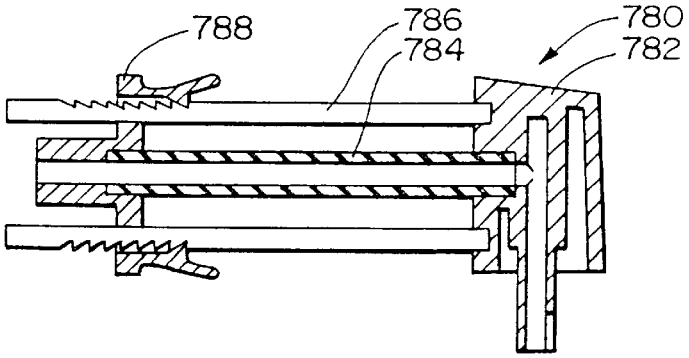
FIGS. 42A and 42B are section views showing the details of construction and operation of yet another exemplary discharge assembly.
Figure 42B:
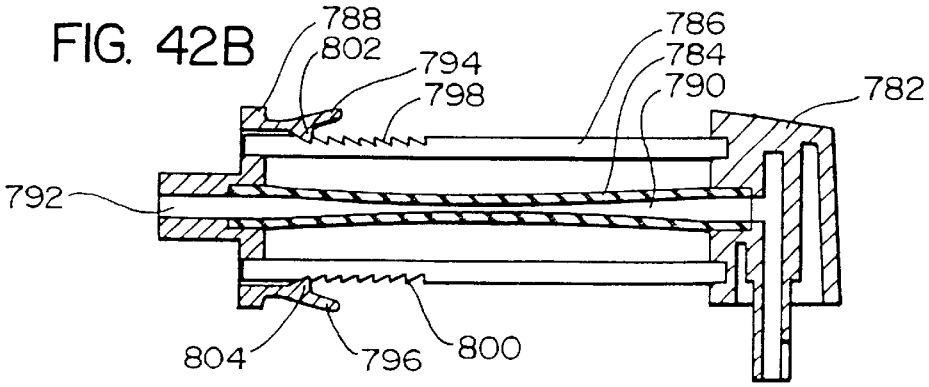

Referring now to FIGS. 42A and 42B, depicted therein is yet another discharge assembly 780 adapted to be mounted on an actuator member 782 that is substituted for the actuator member 610 described above.

The discharge assembly 780 comprises a flexible straw 784, a rigid hollow cylinder 786, and a tensioning plate 788. The straw 784 is securely attached at one end to the actuator member 782 and at its distal end to the tensioning plate 788. A central bore 790 defined by the straw 784 is in communication with a bore 792 formed in the tensioning plate 788. Thus, texture material flowing out of the aerosol portion 602 passes through the bores 790 and 792, at which point it is deposited on the surface being coated.

The outer cylinder 786 is mounted onto the actuator member 782 such that it spaces the tensioning plate 788 in one of a plurality of fixed distances from the actuator member 782. More specifically, extending from the tensioning plate 788 are first and second tabs 794 and 796. Formed on the cylinder 786 are rows of teeth 798 and 800. Engaging portions 802 and 804 on the tabs 794 and 796 are adapted to engage the teeth 798 and 800 to hold the tensioning plate 788 at one of the plurality of locations along the cylinder 786.

As the tensioning plate moves away from the actuator member 782 (compare FIGS. 42A and 42B), the resilient straw 784 becomes stretched, thereby decreasing the cross-sectional area of the bore 790 formed therein. By lifting on the tab 794 and 796, the engaging portions 802 and 804 can be disengaged from the teeth 798 and 800 to allow the tensioning plate 788 to move back towards the actuator member 782. By this process, the cross-sectional area of the bore 790 defined by the flexible straw 784 can be varied to obtain various desired texture patterns.

Figure 43A:
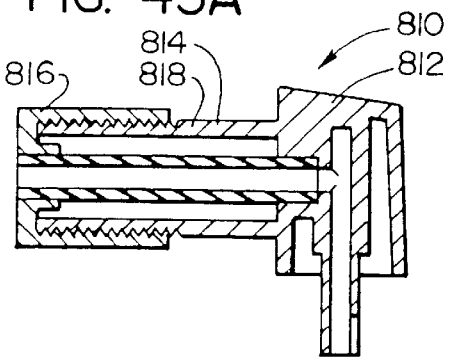
FIGS. 43A and 43B are section views showing the construction and operation of a discharge assembly constructed in accordance with the principles of the present invention.
Figure 43B:
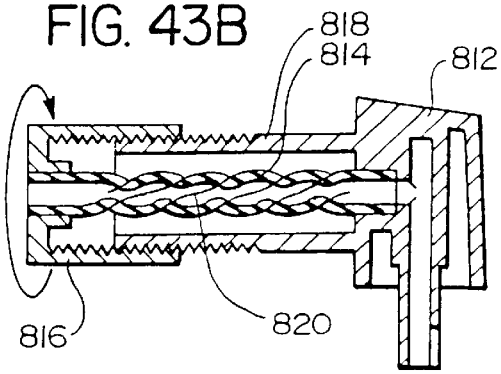

Referring now to FIGS. 43 and 43B, depicted therein is an output assembly 810 adapted to be mounted on an actuator member 812. The actuator member 812 functions in the same basic manner as the actuator member 610 described above but has been adapted to allow the discharge assembly 810 to be mounted thereon.

In particular, the discharge portion 810 comprises a straw 814 and a tensioning cylinder 816. The straw 814 is flexible and is connected at one end to the actuator member 812 and a distal end to the tensioning cylinder 816. The tensioning cylinder 816 is threaded to mount on a spacing cylinder 818 integrally formed with the actuator member 812.

When the tensioning cylinder 816 is rotated about its longitudinal axis, the threads thereon engage the threads on the spacing cylinder 818 to cause the tensioning cylinder 816 to move towards and away from the actuator member 812. Additionally, as the ends of the straw 814 are securely attached to the actuator member and the tensioning cylinder, rotation of the tensioning cylinder 816 causes the straw 814 to twist as shown in FIG. 43B. This twisting reduces the cross-sectional area of a central bore 820 defined by the straw 814 and thus allows texture material passing through this bore 820 to be applied in different texture patterns.

Figure 44:
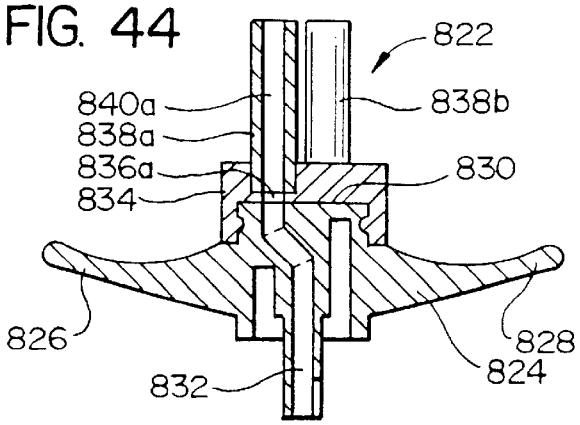

Referring now to FIG. 44, depicted therein is yet another exemplary discharge assembly 822. This discharge portion 822 is adapted to be mounted on an actuator member 824. The actuator member 824 performs the same basic functions as the actuator member 610 described above but has been adapted to direct fluid passing therethrough upwardly rather than laterally. To facilitate this, the actuator member 824 comprises first and second gripping portions 826 and 828 sized and dimensioned to allow the user to pull down on the actuator member 824 while holding the aerosol portion 602 in an upright position. The actuator member 824 further comprises an upper surface 830. An exit passageway 832 at least partially defined by the actuator member 824 terminates at the upper surface 830.

The discharge assembly 822 comprises a mounting cap 834 adapted to be attached to the actuator member 824 such that a plurality of bores 836 in the cap 834 can be brought into registration with the exit passageway 832. Mounted on the mounting cap 834 are a plurality of straws 838 having central bores 840 of different cross-sectional areas. These straws 838 are mounted onto the mounting cap 834 such that the bores 840 are in communication with a corresponding one of the bores 836 formed in the mounting cap 834. By rotating the mounting cap 834 relative to the actuator member 824, one of the central bores 840 is brought into registration with the exit passageway portion 832 such that texture material passing through the exit passageway 832 exits the system through the aligned central bore 840. Each of the straws 838 thus corresponds to a different texture pattern, and the desired texture pattern may be selected by aligning an appropriate central bore 840 with the exit passageway 832.

The system shown in FIG. 44 is particularly suited for the application of texture material in a desired pattern onto a ceiling surface or the like.

Figure 45:
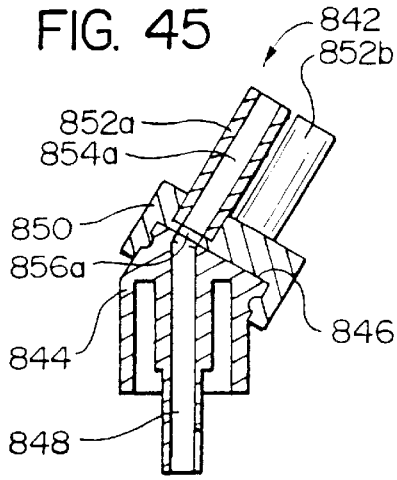

Referring now to FIG. 45, depicted therein is an output portion 842 designed to apply texture material at an angle between vertical and horizontal. This discharge portion 842 is adapted to be mounted on an actuator member 844. The actuator member 844 functions in a manner similar to the actuator member 824 described above. In particular, the actuator member has a canted surface 846 that is angled with respect to both horizontal and vertical. An exit passageway 848 defined by the actuator member 844 terminates at the canted surface 846.

The discharge portion 842 comprises a mounting cap 850 and a plurality of straws 852 mounted on the cap 850. Each of these straws defines a center bore 854. The cross-sectional areas of the central bores 854 are all different and thus allowed the formation of different texture patterns.

The mounting cap 850 has a plurality of bores 856 formed therein, with each bore 856 having a corresponding straw 852. Additionally, the bores 856 are spaced from each other such that rotation of the mounting cap 850 relative to the actuator member 854 aligns one of the bores 856, and thus the central bore 854 of one of the straws 852 such that texture material exiting the aerosol portion 602 passes through a selected central bore 854 of one of the straws 852.

The system shown in FIG. 45 is particularly suited for applying texture material to an upper portion of a wall.

Figure 46:
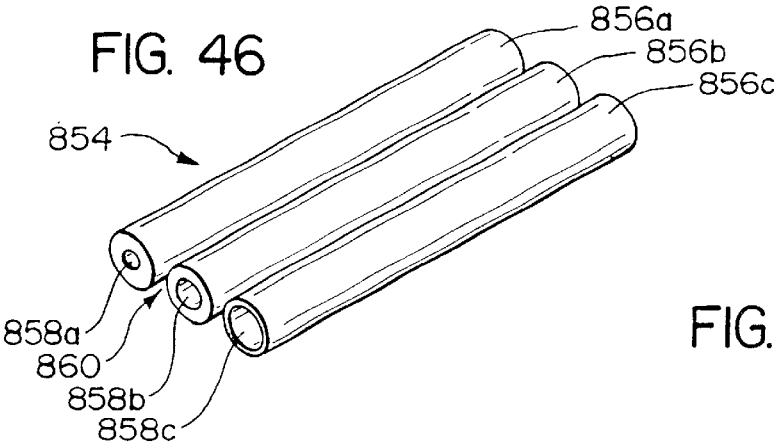
FIG. 46 is an isometric view showing yet another discharge assembly constructed in accordance with, and embodying, the principles of the present invention.

Referring now to FIG. 46, depicted therein is yet another exemplary output assembly 854 that may be mounted onto an actuator member such as the actuator member 610 recited above.

The actuator assembly 854 comprises three straw members 856 each having a central bore 858. These straw members 856 are joined together to form an integral unit, but are spaced from each other as shown at 860 in FIG. 46 to allow them to be mounted onto an actuator member such as the actuator member 610.

The cross-sectional areas of the bores 858*a*, 858*b*, and 858*c* are different, and different spray texture patterns may be obtained by inserting one of the straws into the actuator member such that texture material flows through central bore 858 associated therewith. In this context, it should be apparent that the output portion 854 is used in the same basic manner as the plurality of straws described in relation to FIGS. 1–18, but decreases the likelihood that unused straws will be lost when not in use.

Figure 47:
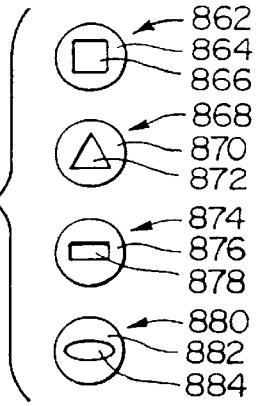
FIG. 47 is a front view showing a number of possible passageway configurations constructed in accordance with the principles of the present invention.

Referring now to FIG. 47, depicted therein are a plurality of central bore configurations that may be employed in place of the cylindrical configurations described above. For example, shown at 862 is a structure 864 defining a square central bore 866. This bore 866 may be square along its entire length or may be made square only at the end portion thereof to reduce the cross-sectional area through which the texture material must pass as it is dispensed.

Shown at 868 is yet another structure 870 defining a bore 872 having a triangular cross section. Shown at 874 is a structure 876 having a bore 878 configured in a rectangular shape. At 880 in FIG. 47 is shown yet another structure 882 that defines a bore 884 having an oval configuration.

Bores such as the bores 878 and 884 described above that are wider than they are tall may, in addition to defining a certain cross-sectional are*a*, also create desirable spray characteristics such as a fan shape.

Figure 48:
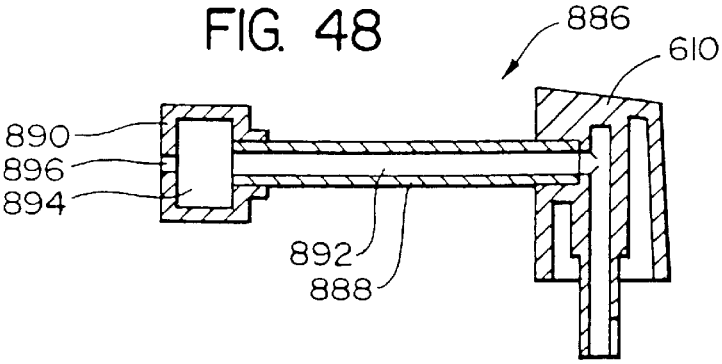
FIG. 48 is a section view of yet another discharge assembly constructed in accordance with the present invention.

Referring now to FIG. 48, depicted therein is yet another output portion 886 adapted to be mounted on the actuator member 610. The output portion 886 comprises a straw 888 and a box member 890. The straw 888 is connected at one end to the actuator member 610 such that texture material exiting the actuator member 610 passes through a central bore 892 defined by the straw 888. The box member 890 is attached to the distal end of the straw 888.

The box member 890 defines a chamber 894 through which texture material must pass before it passes through a discharge opening 896. The chamber 894 acts as a pressure accumulator that will smooth out any variations in pressure in the texture material as it is dispensed through the opening 896.

Figure 49:
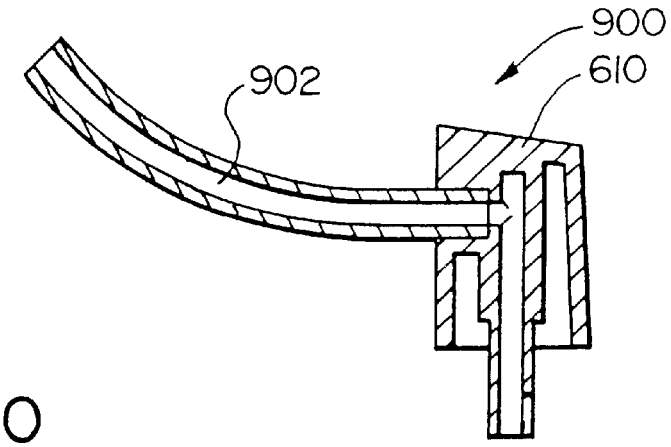
FIGS. 49 and 50 are section views of discharge members adapted to apply texture material to a wall region or a ceiling while still using a conventional discharge member.

Referring now to FIG. 49, there is a discharge member or straw 900 adapted to be mounted on the actuator member 610. The discharge straw 900 defines a central bore 902 through which texture material must pass as it exits the actuator member 610. The straw member 900 is curved such that the texture material leaving the bore 902 moves at an angle relative to both horizontal and vertical.

From the discussion of the other embodiments above, it should be clear that a plurality of curved straws such as the straw 900 may be provided each having an internal bore with a different cross-sectional area. This would allow the texture material not only to be applied upwardly with the aerosol portion 602 being held upright but would allow different spray texture patterns to be applied.

Figure 50:
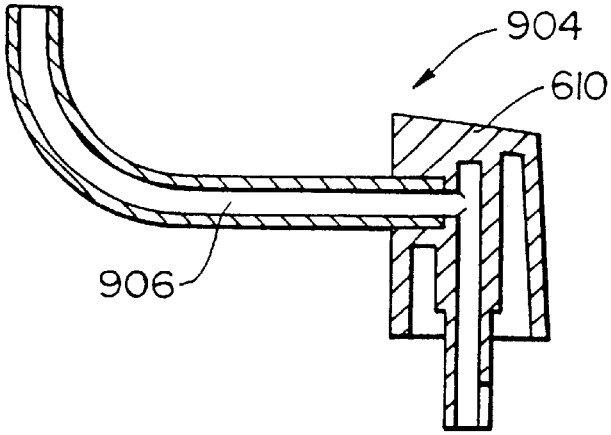

Referring now to FIG. 50, depicted at 904 therein is a discharge member or straw similar to the straw 900 described above. The difference between the straw 904 and the straw 900 is that the straw 904 is curved approximately 90 degree such that the texture material passing through a central bore 906 thereof is substantially parallel to vertical as it leaves the straw 904.

Figure 51:
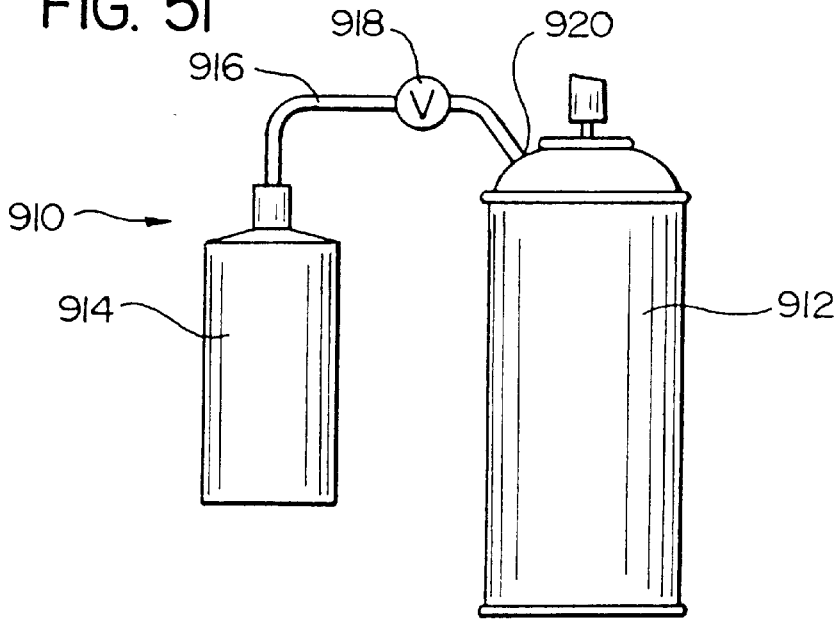
FIG. 51 depicts a somewhat schematic view showing an assembly comprising an aerosol container and a supplemental container adapted to maintain the pressure within the aerosol container at a desired level to provide a consistent texture pattern in accordance with the principles of the in present invention.

Referring now to FIG. 51, depicted therein is an aerosol assembly 910 constructed in accordance with, and embodying, the principles of the present invention. This assembly 910 comprises a main aerosol container 912, a secondary container 914, a conduit 916 allowing fluid communication between the containers 912 and 914, and a valve 918 arranged to regulate the flow of fluid through the conduit 916.

The main container 912 is similar to a conventional aerosol container as described above except that it has an additional port 920 to which the conduit 916 is connected. The secondary container 914 is adapted to contain a pressurized fluid such as air or nitrogen. The pressurized fluid is preferably inert.

The compressed fluid within the secondary container 914 is allowed to enter the primary container 912 to force texture material out of the main container 912. The valve 918 controls the amount of pressure applied on the texture material by the compressed fluid within the secondary container 914.

Thus, rather than relying on an internally provided propellant gas to stay at a desired pressure associated with a consistent spray texture pattern, an external gas source is applied with a valve to ensure that the pressure remains at its desired level while the texture material is being dispensed.

It is to be recognized that various modifications can be made without departing from the basic teaching of the present invention.

What is claimed is:

1. A method of dispensing coating material to form a coating on a surface such that the coating defines an actual pattern that substantially matches a desired pattern, the method comprising the steps of:

providing an aerosol assembly comprising a container, a valve assembly, and an actuator member, where the aerosol assembly defines an outlet opening and an effective cross-sectional area of the outlet opening defines the actual pattern;

placing texture material into the container;

placing propellant material into the container such that, when the actuator member is depressed, the valve assembly is placed into an open configuration in which the propellant may force the coating material out of the container through the outlet opening in the aerosol assembly;

altering the effective cross-sectional area of the outlet opening to obtain a desired cross-sectional area, where the desired cross-sectional area corresponds to the desired pattern; and depressing the actuator member to dispense the coating material from the outlet opening and onto the surface in the actual pattern such that the actual pattern substantially matches the desired pattern.

2. A method as recited in claim 1, in which:

the step of providing the aerosol assembly comprises the step of providing a plurality of tube members each having a bore formed therein, where the bores define the outlet opening and each bore has a cross-sectional area predetermined to correspond to one of a plurality of desired patterns; and the step of altering the effective cross-sectional area of the outlet opening comprises the steps of selecting one of the tube members, and arranging the selected tube member such that coating material flowing out of the aerosol assembly flows through the bore of the selected tube member before being deposited onto the surface.

3. A method as recited in claim 1, in which:

the step of providing the aerosol assembly comprises the step of providing an outlet member defining a plurality of bores, where the bores define the outlet opening and each bore has a cross-sectional area predetermined to correspond to one of a plurality of desired patterns; and the step of altering the effective cross-sectional area of the outlet opening comprises the steps of selecting one of the bores, and arranging the selected bore such that coating material flowing out of the aerosol assembly flows through the selected bore before being deposited onto the surface.

4. A method as recited in claim 3, in which:

the step of providing the aerosol assembly further comprises the step of forming an actuator opening in the actuator member such that the coating material forced out of the container passes through the actuator opening; and the step of altering the effective cross-sectional area of the outlet opening comprises the steps of rotatably attaching the outlet member to the actuator member, and rotating the outlet member relative to the actuator member such that the selected bore is aligned with the actuator opening.

5. A method as recited in claim 1, in which:

the step of providing the aerosol assembly further comprises the step of providing a plurality of restriction members; and the step of altering the effective cross-sectional area of the outlet opening comprises the steps of selecting one of the plurality of restriction members, and attaching the selected restriction member to the outlet assembly.

6. A method as recited in claim 5, in which the step of attaching the selected restriction member to the outlet assembly comprises the steps of:

attaching a tube member to the actuator member, where the tube member defines a bore; and attaching the selected restriction member to the tube member.

7. A method as recited in claim 1, in which:

the step of providing the aerosol assembly comprises the step of providing a deformable tube member having a bore formed therein, where the bore defines the outlet opening and deforming the tube member alters the cross-sectional area of the outlet opening; and the step of altering the effective cross-sectional area of the outlet opening comprises the steps of deforming the tube member such that the cross-sectional area of the outlet opening corresponds to one of a continuum of desired texture patterns; and arranging the tube member such that coating material flowing out of the aerosol assembly flows through the bore of the tube member before being deposited onto the surface.

8. A method as recited in claim 7, in which the steps of: providing the aerosol assembly comprises the step of providing a collar member;

movably mounting the collar member relative to the actuator member such that moving the collar member in a predetermined fashion alters an effective distance between the collar member and the actuator member; and engaging the collar member and the tube member such that moving the collar member in the predetermined fashion deforms the tube member.

9. A method as recited in claim 8, in which:

the step of providing the aerosol assembly comprises the steps of forming a first threaded surface on the collar member, and forming a second threaded surface on the aerosol assembly that is fixed relative to the actuator member; and the step of movably mounting the collar member relative to the actuator member comprises the steps of engaging the first and second threaded surfaces, and rotating the collar member.

10. A method as recited in claim 8, in which:

the step of providing the aerosol assembly comprises the steps of forming a detent projection on the collar member, and forming a notched surface on the aerosol assembly that is fixed relative to the actuator member; and the step of movably mounting the collar member relative to the actuator member comprises the steps of engaging the detent projection with the notched surface, and sliding the collar member such that the detent projection engages the notched surface to fix the collar member at one of a plurality of locations relative to the actuator member.

11. A system for dispensing coating material to form a coating on a surface such that the coating defines an actual pattern that substantially matches a desired pattern, the system comprising:

an aerosol assembly comprising a container, a valve assembly, and an actuator member, where the aerosol assembly defines an outlet opening and an effective cross-sectional area of the outlet opening defines the actual pattern;

texture material within the container;

propellant material within the container, where, when the actuator member is depressed, the valve assembly is placed into an open configuration in which the propellant may force the coating material out of the container through the outlet opening in the aerosol assembly;

a cross-sectional area altering structure for altering the effective cross-sectional area of the outlet opening to obtain a desired cross-sectional area, where the desired cross-sectional area corresponds to the desired pattern; whereby depressing the actuator member dispenses the coating material from the outlet opening and onto the surface in the actual pattern such that the actual pattern substantially matches the desired pattern.

12. A system as recited in claim 11, further comprising:

a plurality of tube members each having a bore formed therein, where the bores define the outlet opening and each bore has a cross-sectional area predetermined to correspond to one of a plurality of desired patterns; whereby a selected one of the tube members is arranged such that coating material flowing out of the aerosol assembly flows through the bore of the selected tube member before being deposited onto the surface.

13. A method as recited in claim 11, further comprising:

an outlet member defining a plurality of bores, where each bore has a cross-sectional area predetermined to correspond to one of a plurality of desired patterns; whereby the outlet member is arranged such that a selected one of the bores defines the outlet opening; and coating material flowing out of the aerosol assembly flows through the selected bore before being deposited onto the surface.

14. A method as recited in claim 13, in which:

an actuator opening is formed in the actuator member such that the coating material forced out of the container passes through the actuator opening, the system further comprising; and the outlet member is rotatably attached to the actuator member such that rotating the outlet member relative to the actuator member aligns the selected bore with the actuator opening.

15. A system as recited in claim 11, further comprising a plurality of restriction members, where a selected one of the plurality of restriction members is attached to the outlet assembly.

16. A system as recited in claim 15, further comprising a tube member attached to the actuator member, where the tube member defines a bore and the selected restriction member is attached to the tube member.

17. A system as recited in claim 11, further comprising a deformable tube member having a bore formed therein, where the bore defines the outlet opening and deforming the tube member alters the cross-sectional area of the outlet opening; whereby the tube member is deformed such that the cross-sectional area of the outlet opening corresponds to one of a continuum of desired texture patterns; and the tube member is arranged such that coating material flowing out of the aerosol assembly flows through the bore of the tube member before being deposited onto the surface.

18. A system as recited in claim 17, in which the steps of:

providing the aerosol assembly comprises the step of providing a collar member;

movably mounting the collar member relative to the actuator member such that moving the collar member in a predetermined fashion alters an effective distance between the collar member and the actuator member; and engaging the collar member and the tube member such that moving the collar member in the predetermined fashion deforms the tube member.

19. A system as recited in claim 18, in which:

a first threaded surface is formed on the collar member, and a second threaded surface is formed on the aerosol assembly; wherein the second threaded surface is fixed relative to the actuator member; and the first and second threaded surfaces are engaged such that rotating the collar member moves the collar member relative to the actuator member.

20. A method as recited in claim 18, in which:

a detent projection is formed on the collar member; and a notched surface is formed on the aerosol assembly; wherein the notched surface is fixed relative to the actuator member; and the detent projection engages the notched surface, where the collar member slides such that the detent projection engages the notched surface to fix the collar member at one of a plurality of locations relative to the actuator member.

* * * * *